US007889159B2

(12) United States Patent
Nathan et al.

(10) Patent No.: US 7,889,159 B2
(45) Date of Patent: Feb. 15, 2011

(54) SYSTEM AND DRIVING METHOD FOR ACTIVE MATRIX LIGHT EMITTING DEVICE DISPLAY

(75) Inventors: Arokia Nathan, Waterloo (CA); Gholamreza Reza Chaji, Waterloo (CA); Peyman Servati, Waterloo (CA)

(73) Assignee: Ignis Innovation Inc., Kitchener, Ontario (CA)

( * ) Notice: Subject to any disclaimer, the term of this patent is extended or adjusted under 35 U.S.C. 154(b) by 1106 days.

(21) Appl. No.: 11/274,957

(22) Filed: Nov. 15, 2005

(65) Prior Publication Data

US 2006/0125408 A1 Jun. 15, 2006

(30) Foreign Application Priority Data

Nov. 16, 2004 (CA) ..... 2490848
Apr. 8, 2005 (CA) ..... 2503283

(51) Int. Cl.
*G09G 3/32* (2006.01)

(52) U.S. Cl. ..... 345/82; 345/77

(58) Field of Classification Search ..... 345/76–83
See application file for complete search history.

(56) References Cited

U.S. PATENT DOCUMENTS 6,414,661 B1 7/2002 Shen et al.
6,433,488 B1 8/2002 Bu
6,501,466 B1 12/2002 Yamagishi et al.
7,038,392 B2 5/2006 Libsch et al.
2002/0195968 A1 12/2002 Sanford et al.
2003/0112205 A1 6/2003 Yamada
2003/0156104 A1* 8/2003 Morita ..... 345/204
2004/0041750 A1* 3/2004 Abe ..... 345/76
2004/0174349 A1* 9/2004 Libsch et al. ..... 345/204
2005/0057459 A1* 3/2005 Miyazawa ..... 345/76

FOREIGN PATENT DOCUMENTS

CA 2507276 8/2002
CA 2463653 1/2004
CA 2519097 8/2005
EP 1473689 A 11/2009

OTHER PUBLICATIONS

Alexander et al.: "Pixel circuits and drive schemes for glass and elastic AMOLED displays"; dated Jul. 2005 (9 pages).
Chaji et al.: "A low-power driving scheme for a-Si:H active-matrix organic light-emitting diode displays"; dated Jun. 2005 (4 pages).

(Continued)

*Primary Examiner*—Kevin M Nguyen
(74) *Attorney, Agent, or Firm*—Nixon Peabody LLP

(57) ABSTRACT

Active matrix light emitting device display and its driving technique is provided. The pixel includes a light emitting device and a plurality of transistors. A capacitor may be used to store a voltage applied to a driving transistor so that a current through the light emitting device is independent of any shifts of the transistor and light emitting device characteristics. A bias data and a programming data are provided to the pixel circuit in accordance with a driving scheme.

32 Claims, 23 Drawing Sheets

OTHER PUBLICATIONS

Chaji et al.: "A low-power high-performance digital circuit for deep submicron technologies"; dated Jun. 2005 (4 pages).

Chaji et al.: "A novel a-Si:H AMOLED pixel circuit based on short-term stress stability of a-Si:H TFTs"; dated Oct. 2005 (3 pages).

Chaji et al.: "A novel driving scheme for high-resolution large-area a-Si:H AMOLED displays"; dated Aug. 2005 (4 pages).

Chaji et al.: "Driving scheme for stable operation of 2-TFT a-Si AMOLED pixel"; dated Apr. 2005 (2 pages).

Chaji et al.: "Dynamic-effect compensating technique for stable a-Si:H AMOLED displays"; dated Aug. 2005 (4 pages).

Chaji et al.: "eUTDSP: a design study of a new VLIW-based DSP architecture"; dated My 2003 (4 pages).

Chaji et al.: "High Speed Low Power Adder Design With a New Logic Style: Pseudo Dynamic Logic (SDL)"; dated Oct. 2001 (4 pages).

Chaji et al.: "Pseudo dynamic logic (SDL): a high-speed and low-power dynamic logic family"; dated 2002 (4 pages).

European Search Report for European Application No. EP 05 80 7905 dated Apr. 2, 2009 (5 pages).

International Search Report for International Application No. PCT/CA2005/001730 dated Feb. 27, 2006 (2 pages).

Jafarabadiashtiani et al.: "A New Driving Method for a-Si AMOLED Displays Based on Voltage Feedback"; dated 2005 (4 pages).

Matsueda y et al.: "35.1: 2.5-in. AMOLED with Integrated 6-bit Gamma Compensated Digital Data Driver"; dated May 2004 (4 pages).

Philipp: "Charge transfer sensing" Sensor Review, vol. 19, No. 2, Dec. 31, 1999, 10 pages.

Rafati et al.: "Comparison of a 17 b multiplier in Dual-rail domino and in Dual-rail D L (D L) logic styles"; dated 2002 (4 pages).

Safavian et al.: "Self-compensated a-Si:H detector with current-mode readout circuit for digital X-ray fluoroscopy"; dated Aug. 2005 (4 pages).

Safavian et al.: "TFT active image sensor with current-mode readout circuit for digital x-ray fluoroscopy [5969D-82]"; dated Sep. 2005 (9 pages).

* cited by examiner $$V1 = VB - \sqrt{\frac{IB}{\beta}} - VT$$

$$V1 = VB - \sqrt{\frac{IB}{\beta}} - VT$$

SYSTEM AND DRIVING METHOD FOR ACTIVE MATRIX LIGHT EMITTING DEVICE DISPLAY

FIELD OF INVENTION

The present invention relates to a light emitting device displays, and more specifically to a driving technique for the light emitting device displays.

BACKGROUND OF THE INVENTION

Recently active-matrix organic light-emitting diode (AMOLED) displays with amorphous silicon (a—Si), polysilicon, organic, or other driving backplane technology have become more attractive due to advantages over active matrix liquid crystal displays. An AMOLED display using a—Si backplanes, for example, has the advantages which include low temperature fabrication that broadens the use of different substrates and makes flexible displays feasible, and its low cost fabrication is well-established and yields high resolution displays with a wide viewing angle.

An AMOLED display includes an array of rows and columns of pixels, each having an organic light-emitting diode (OLED) and backplane electronics arranged in the array of rows and columns. Since the OLED is a current driven device, the pixel circuit of the AMOLED should be capable of providing an accurate and constant drive current.

One method that has been employed to drive the AMOLED display is programming the AMOLED pixel directly with current. However, the small current required by the OLED, coupled with a large parasitic capacitance, undesirably increases the settling time of the programming of the current-programmed AMOLED display. Furthermore, it is difficult to design an external driver to accurately supply the required current. For example, in CMOS technology, the transistors must work in sub-threshold regime to provide the small current required by the OLEDs, which is not ideal. Therefore, in order to use current-programmed AMOLED pixel circuits, suitable driving schemes are desirable.

Current scaling is one method that can be used to manage issues associated with the small current required by the OLEDs. In a current mirror pixel circuit, the current passing through the OLED can be scaled by having a smaller drive transistor as compared to the mirror transistor. However, this method is not applicable for other current-programmed pixel circuits. Also, by resizing the two mirror transistors the effect of mismatch increases.

SUMMARY OF THE INVENTION

It is an object of the invention to provide a method and system that obviates or mitigates at least one of the disadvantages of existing systems.

In accordance with an aspect of the present invention there is provided a display system including: a pixel circuit having a light emitting device and a plurality of transistors, the plurality of transistors including a driving transistor for providing a pixel current to the light emitting device; a driver for programming and driving the pixel circuit, the driver providing a controllable bias signal to the pixel circuit to accelerate the programming of the pixel circuit and to compensate for a time dependent parameter of the pixel circuit; and a controller for controlling the driver to generate a stable pixel current.

In accordance with a further aspect of the present invention there is provided a pixel circuit including: a light emitting device; and a plurality of transistors, the plurality of transistors including a driving transistor for providing a pixel current to the light emitting device; wherein the pixel circuit is programmed and driven by a driver, the driver providing a controllable bias signal to the pixel circuit to accelerate the programming of the pixel circuit and to compensate for a time dependent parameter of the pixel circuit.

This summary of the invention does not necessarily describe all features of the invention.

Other aspects and features of the present invention will be readily apparent to those skilled in the art from a review of the following detailed description of preferred embodiments in conjunction with the accompanying drawings.

BRIEF DESCRIPTION OF THE DRAWINGS

These and other features of the invention will become more apparent from the following description in which reference is made to the appended drawings wherein.

DETAILED DESCRIPTION OF THE PREFERRED EMBODIMENTS OF THE INVENTION

Embodiments of the present invention are described using a pixel having an organic light emitting diode (OLED) and a driving thin film transistor (TFT). However, the pixel may include any light emitting device other than OLED, and the pixel may include any driving transistor other than TFT. It is noted that in the description, "pixel circuit" and "pixel" may be used interchangeably.

A driving technique for pixels, including a current-biased voltage-programmed (CBVP) driving scheme, is now described in detail. The CBVP driving scheme uses voltage to provide for different gray scales (voltage programming), and uses a bias to accelerate the programming and compensate for the time dependent parameters of a pixel, such as a threshold voltage shift and OLED voltage shift.

Figure 1:
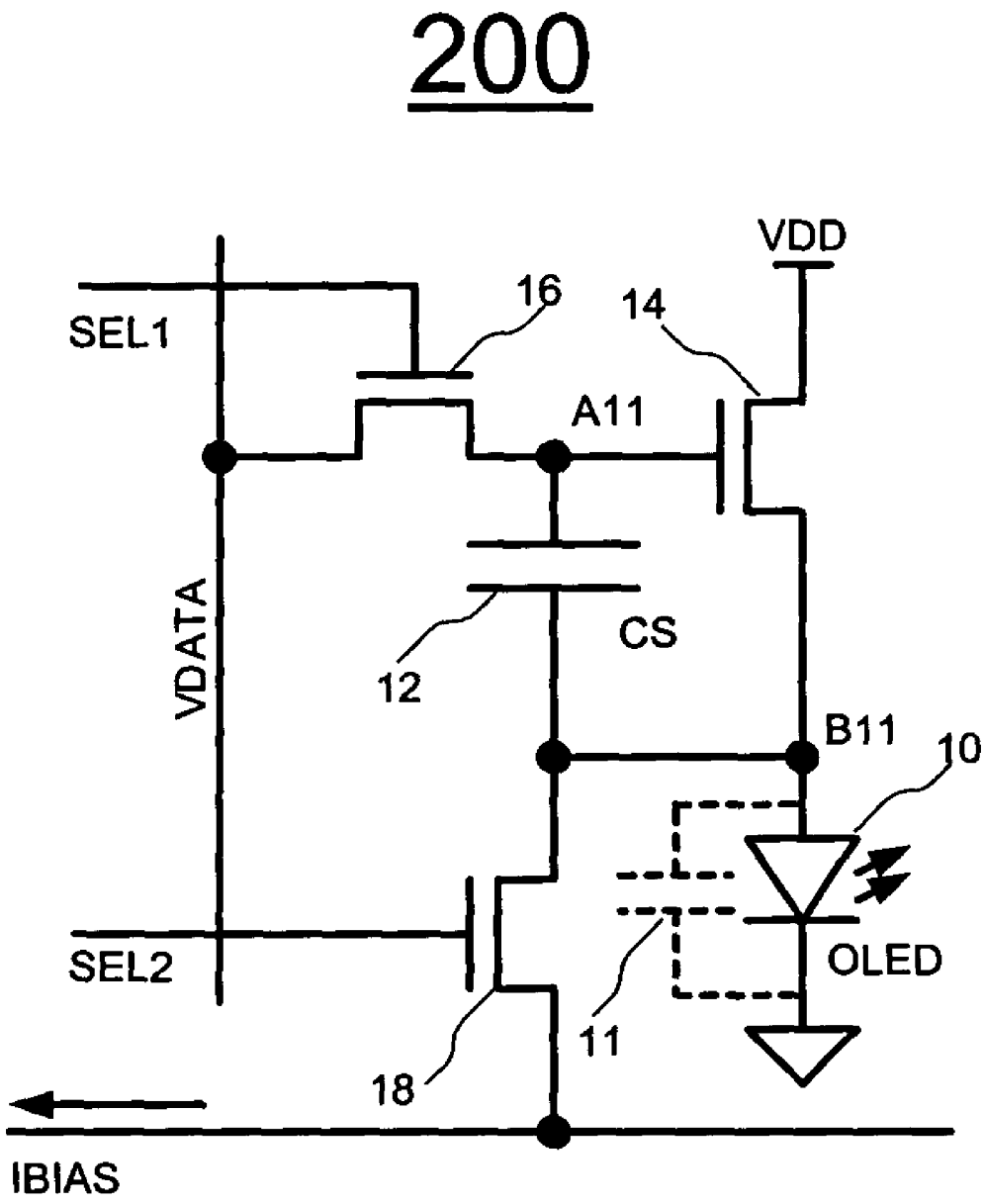
FIG. 1 is a diagram showing a pixel circuit in accordance with an embodiment of the present invention.

FIG. 1 illustrates a pixel circuit 200 in accordance with an embodiment of the present invention. The pixel circuit 200 employs the CBVP driving scheme as described below. The pixel circuit 200 of FIG. 1 includes an OLED 10, a storage capacitor 12, a driving transistor 14, and switch transistors 16 and 18. Each transistor has a gate terminal, a first terminal and a second terminal. In the description, "first terminal" ("second terminal") may be, but not limited to, a drain terminal or a source terminal (source terminal or drain terminal).

Figure 5:
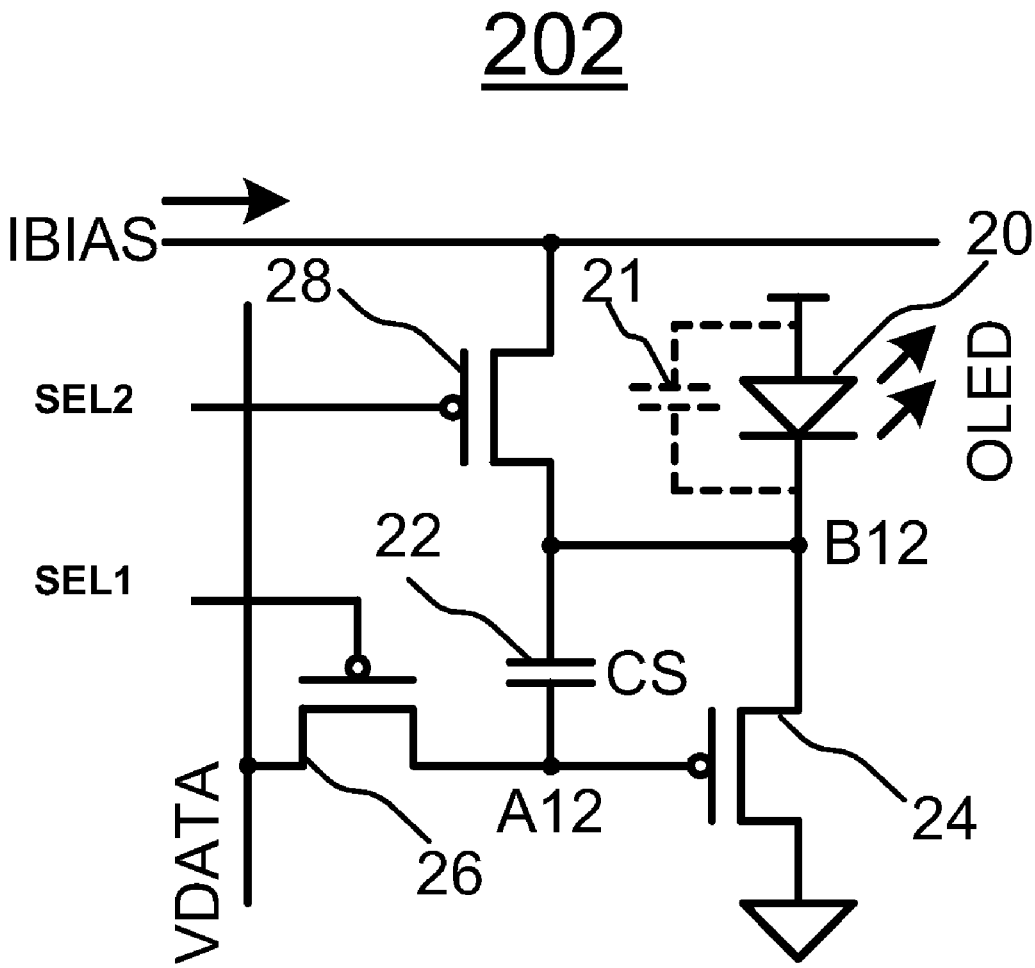
FIG. 5 is a diagram showing a pixel circuit which has p-type transistors and corresponds to the pixel circuit of FIG. 1.

The transistors 14, 16 and 18 are n-type TFT transistors. The driving technique applied to the pixel circuit 200 is also applicable to a complementary pixel circuit having p-type transistors as shown in FIG. 5.

The transistors 14, 16 and 18 may be fabricated using amorphous silicon, nano/micro crystalline silicon, poly silicon, organic semiconductors technologies (e.g. organic TFTs), NMOS technology, or CMOS technology (e.g. MOSFET). A plurality of pixel circuits 200 may form an AMOLED display array.

Two select lines SEL1 and SEL2, a signal line VDATA, a bias line IBIAS, a voltage supply line VDD, and a common ground are provided to the pixel circuit 200. In FIG. 1, the common ground is for the OLED top electrode. The common ground is not a part of the pixel circuit, and is formed at the final stage when the OLED 10 is formed.

The first terminal of the driving transistor 14 is connected to the voltage supply line VDD. The second terminal of the driving transistor 14 is connected to the anode electrode of the OLED 10. The gate terminal of the driving transistor 14 is connected to the signal line VDATA through the switch transistor 16. The storage capacitor 12 is connected between the second and gate terminals of the driving transistor 14.

The gate terminal of the switch transistor 16 is connected to the first select line SEL1. The first terminal of the switch transistor 16 is connected to the signal line VDATA. The second terminal of the switch transistor 16 is connected to the gate terminal of the driving transistor 14.

The gate terminal of the switch transistor 18 is connected to the second select line SEL2. The first terminal of transistor 18 is connected to the anode electrode of the OLED 10 and the storage capacitor 12. The second terminal of the switch transistor 18 is connected to the bias line IBIAS. The cathode electrode of the OLED 10 is connected to the common ground.

The transistors 14 and 16 and the storage capacitor 12 are connected to node A11. The OLED 10, the storage capacitor 12 and the transistors 14 and 18 are connected to B11.

The operation of the pixel circuit 200 includes a programming phase having a plurality of programming cycles, and a driving phase having one driving cycle. During the programming phase, node B11 is charged to negative of the threshold voltage of the driving transistor 14, and node A11 is charged to a programming voltage VP.

As a result, the gate-source voltage of the driving transistor 14 is:

$$VGS=VP-(-VT)=VP+VT \tag{1}$$

where VGS represents the gate-source voltage of the driving transistor 14, and VT represents the threshold voltage of the driving transistor 14. This voltage remains on the capacitor 12 in the driving phase, resulting in the flow of the desired current through the OLED 10 in the driving phase.

Figure 2:
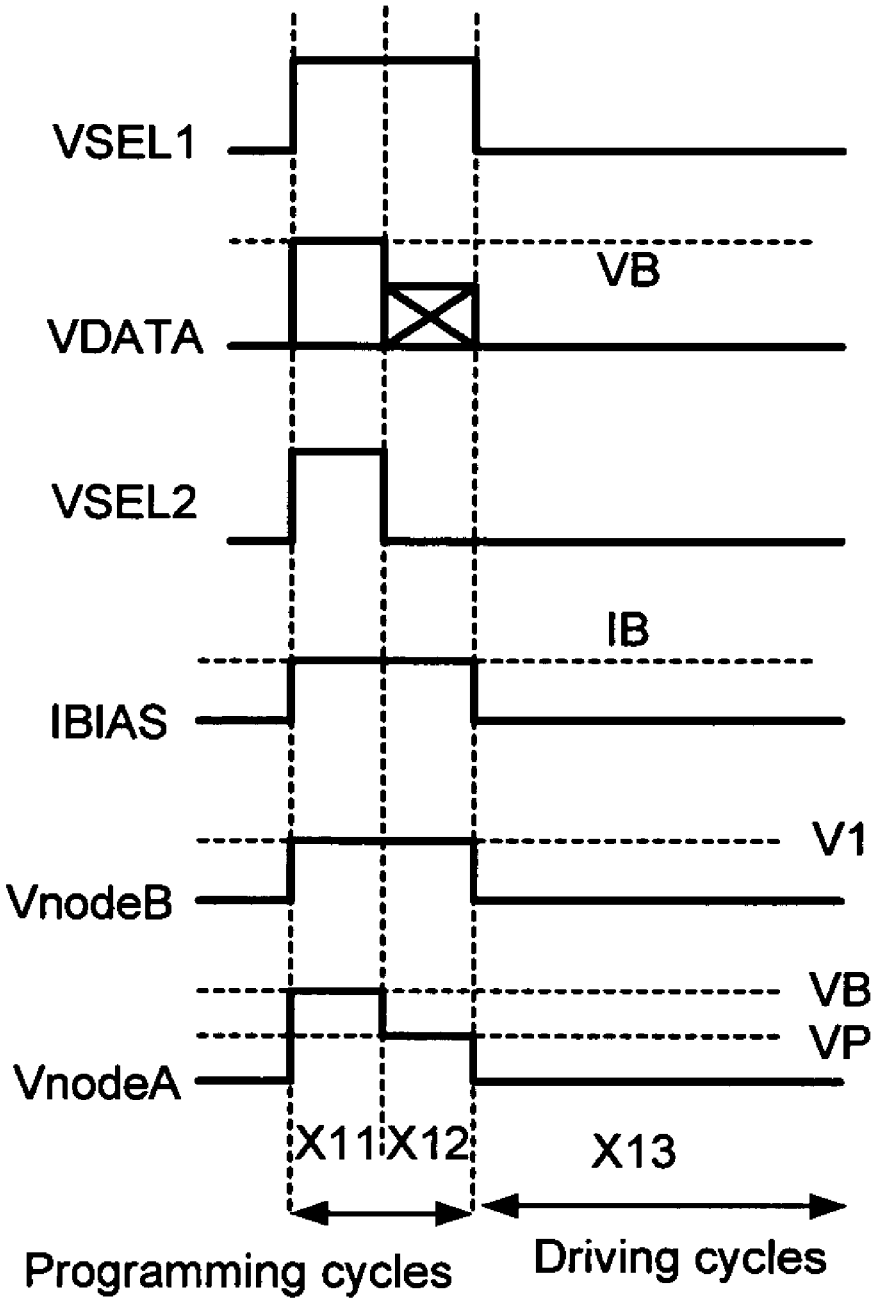
FIG. 2 is a timing diagram showing exemplary waveforms applied to the pixel circuit of FIG. 1.

The programming and driving phases of the pixel circuit 200 are described in detail. FIG. 2 illustrates one exemplary operation process applied to the pixel circuit 200 of FIG. 1. In FIG. 2, VnodeB represents the voltage of node B11, and VnodeA represents the voltage of node A11. As shown in FIG. 2, the programming phase has two operation cycles X11, X12, and the driving phase has one operation cycle X13.

The first operation cycle X11: Both select lines SEL1 and SEL2 are high. A bias current IB flows through the bias line IBIAS, and VDATA goes to a bias voltage VB.

As a result, the voltage of node B11 is:

$$VnodeB = VB - \sqrt{\frac{I\beta}{\beta}} - VT \tag{2}$$

where VnodeB represents the voltage of node B11, VT represents the threshold voltage of the driving transistor 14, and β represents the coefficient in current-voltage (I-V) characteristics of the TFT given by $IDS=\beta(VGS-VT)^2$. IDS represents the drain-source current of the driving transistor 14.

The second operation cycle X12: While SEL2 is low, and SEL1 is high, VDATA goes to a programming voltage VP. Because the capacitance 11 of the OLED 20 is large, the voltage of node B11 generated in the previous cycle stays intact.

Therefore, the gate-source voltage of the driving transistor 14 can be found as:

$$VGS = VP + \Delta VB + VT \tag{3}$$

$$\Delta VB = \sqrt{\frac{I\beta}{\beta}} - VB \tag{4}$$

ΔVB is zero when VB is chosen properly based on (4). The gate-source voltage of the driving transistor 14, i.e., VP+VT, is stored in the storage capacitor 12.

The third operation cycle X13: IBIAS goes to low. SEL1 goes to zero. The voltage stored in the storage capacitor 12 is applied to the gate terminal of the driving transistor 14. The driving transistor 14 is on. The gate-source voltage of the driving transistor 14 develops over the voltage stored in the storage capacitor 12. Thus, the current through the OLED 10 becomes independent of the shifts of the threshold voltage of the driving transistor 14 and OLED characteristics.

Figure 3:
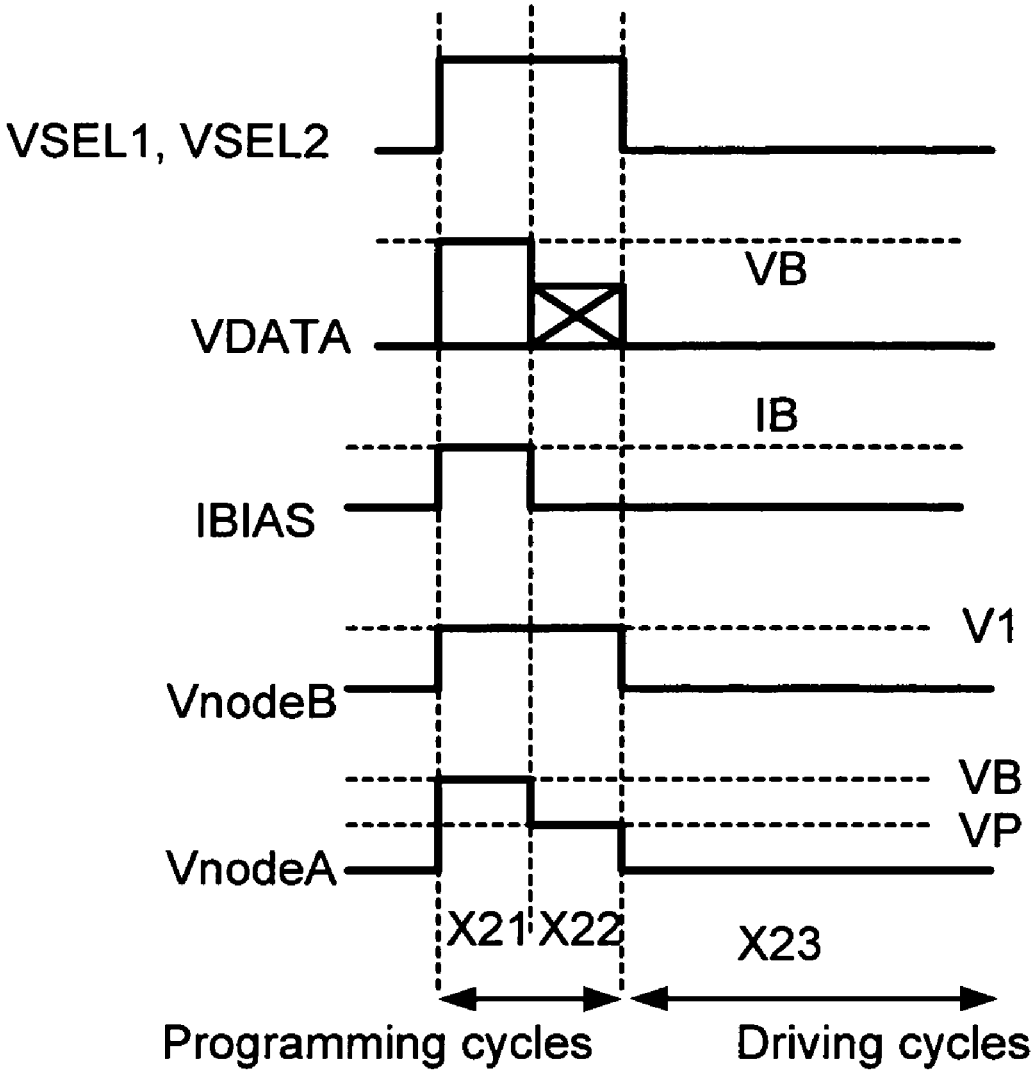
FIG. 3 is a timing diagram showing further exemplary waveforms applied to the pixel circuit of FIG. 1.

FIG. 3 illustrates a further exemplary operation process applied to the pixel circuit 200 of FIG. 1. In FIG. 3, VnodeB represents the voltage of node B11, and VnodeA represents the voltage of node A11.

The programming phase has two operation cycles X21, X22, and the driving phase has one operation cycle X23. The first operation cycle X21 is same as the first operation cycle X11 of FIG. 2. The third operation cycle X33 is same as the third operation cycle X 13 of FIG. 2. In FIG. 3, the select lines SEL1 and SEL2 have the same timing. Thus, SEL1 and SEL2 may be connected to a common select line.

The second operating cycle X22: SEL1 and SEL2 are high. The switch transistor 18 is on. The bias current IB flowing through IBIAS is zero.

The gate-source voltage of the driving transistor 14 can be VGS=VP+VT as described above. The gate-source voltage of the driving transistor 14, i.e., VP+VT, is stored in the storage capacitor 12.

Figure 4:
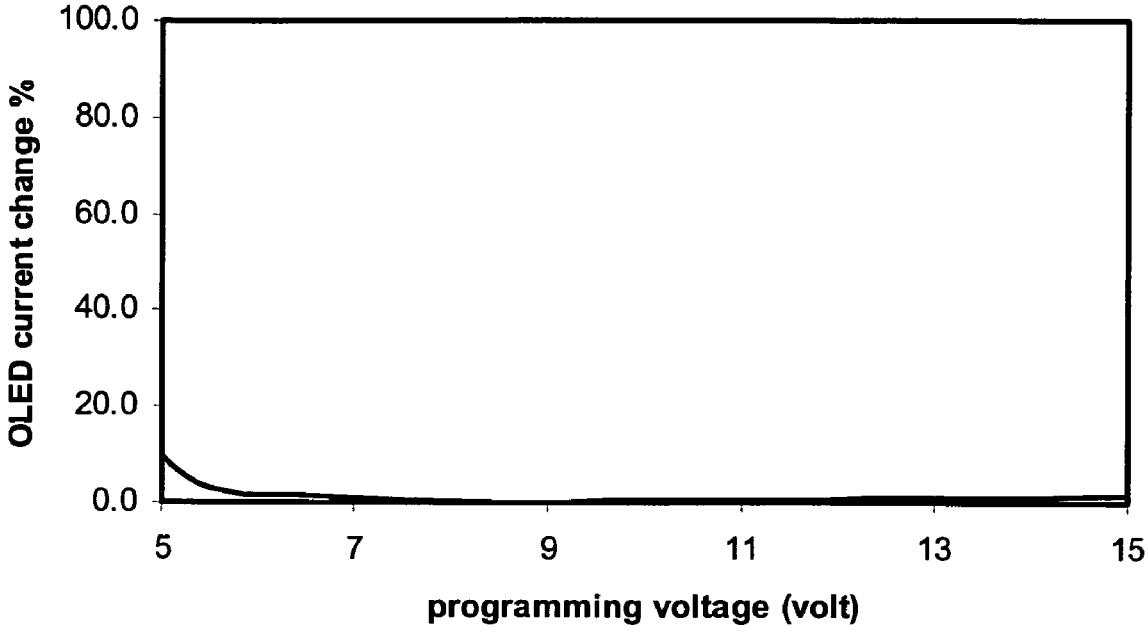
FIG. 4 is a graph showing a current stability of the pixel circuit of FIG. 1.

FIG. 4 illustrates a simulation result for the pixel circuit 200 of FIG. 1 and the waveforms of FIG. 2. The result shows that the change in the OLED current due to a 2-volt VT-shift in the driving transistor (e.g. 14 of FIG. 1) is almost zero percent for most of the programming voltage. Simulation parameters, such as threshold voltage, show that the shift has a high percentage at low programming voltage.

Figure 6:
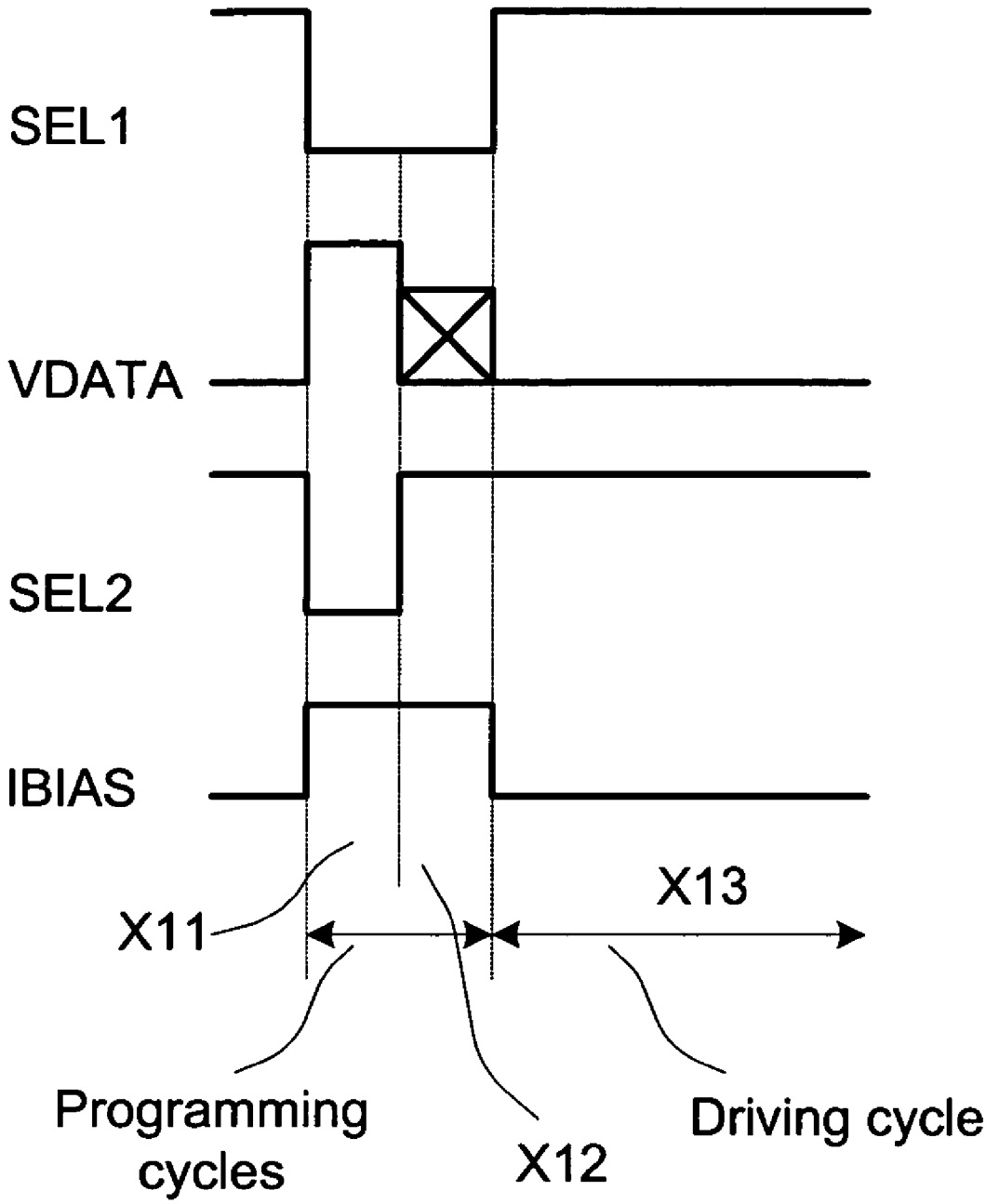
FIG. 6 is a timing diagram showing exemplary waveforms applied to the pixel circuit of FIG. 5.
Figure 7:
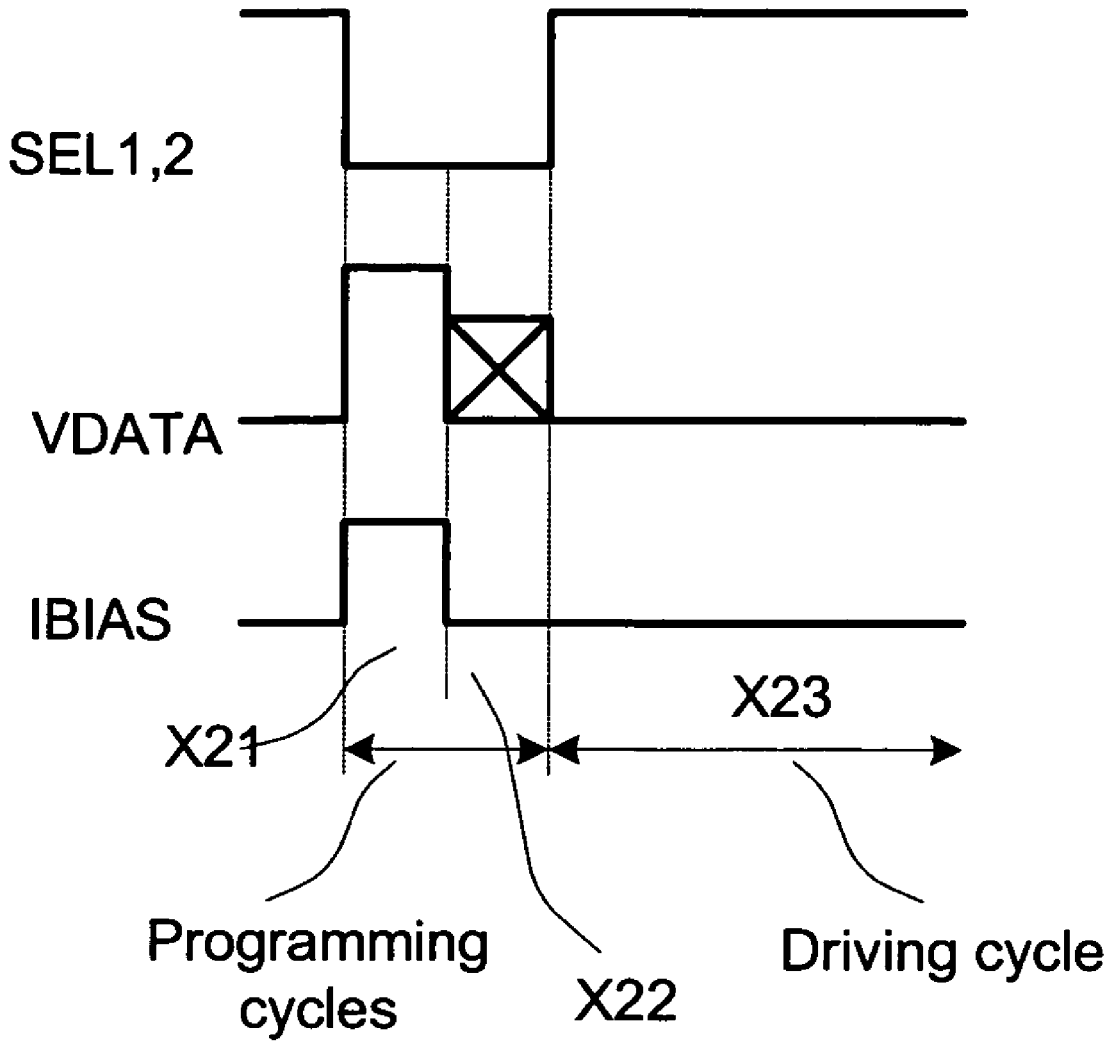
FIG. 7 is a timing diagram showing further exemplary waveforms applied to the pixel circuit of FIG. 5.

FIG. 5 illustrates a pixel circuit 202 having p-type transistors. The pixel circuit 202 corresponds to the pixel circuit 200 of FIG. 1. The pixel circuit 202 employs the CBVP driving scheme as shown in FIGS. 6-7. The pixel circuit 202 includes an OLED 20, a storage capacitor 22, a driving transistor 24, and switch transistors 26 and 28. The transistors 24, 26 and 28 are p-type transistors. Each transistor has a gate terminal, a first terminal and a second terminal.

The transistors 24, 26 and 28 may be fabricated using amorphous silicon, nano/micro crystalline silicon, poly silicon, organic semiconductors technologies (e.g. organic TFTs), PMOS technology, or CMOS technology (e.g. MOSFET). A plurality of pixel circuits 202 may form an AMOLED display array.

Two select lines SEL1 and SEL2, a signal line VDATA, a bias line IBIAS, a voltage supply line VDD, and a common ground are provided to the pixel circuit 202.

The transistors 24 and 26 and the storage capacitor 22 are connected to node A12. The cathode electrode of the OLED 20, the storage capacitor 22 and the transistors 24 and 28 are connected to B12. Since the OLED cathode is connected to the other elements of the pixel circuit 202, this ensures integration with any OLED fabrication.

FIG. 6 illustrates one exemplary operation process applied to the pixel circuit 202 of FIG. 5. FIG. 6 corresponds to FIG. 2. FIG. 7 illustrates a further exemplary operation process applied to the pixel circuit 202 of FIG. 5. FIG. 7 corresponds to FIG. 3. The CBVP driving schemes of FIGS. 6-7 use IBIAS and VDATA similar to those of FIGS. 2-3.

Figure 8:
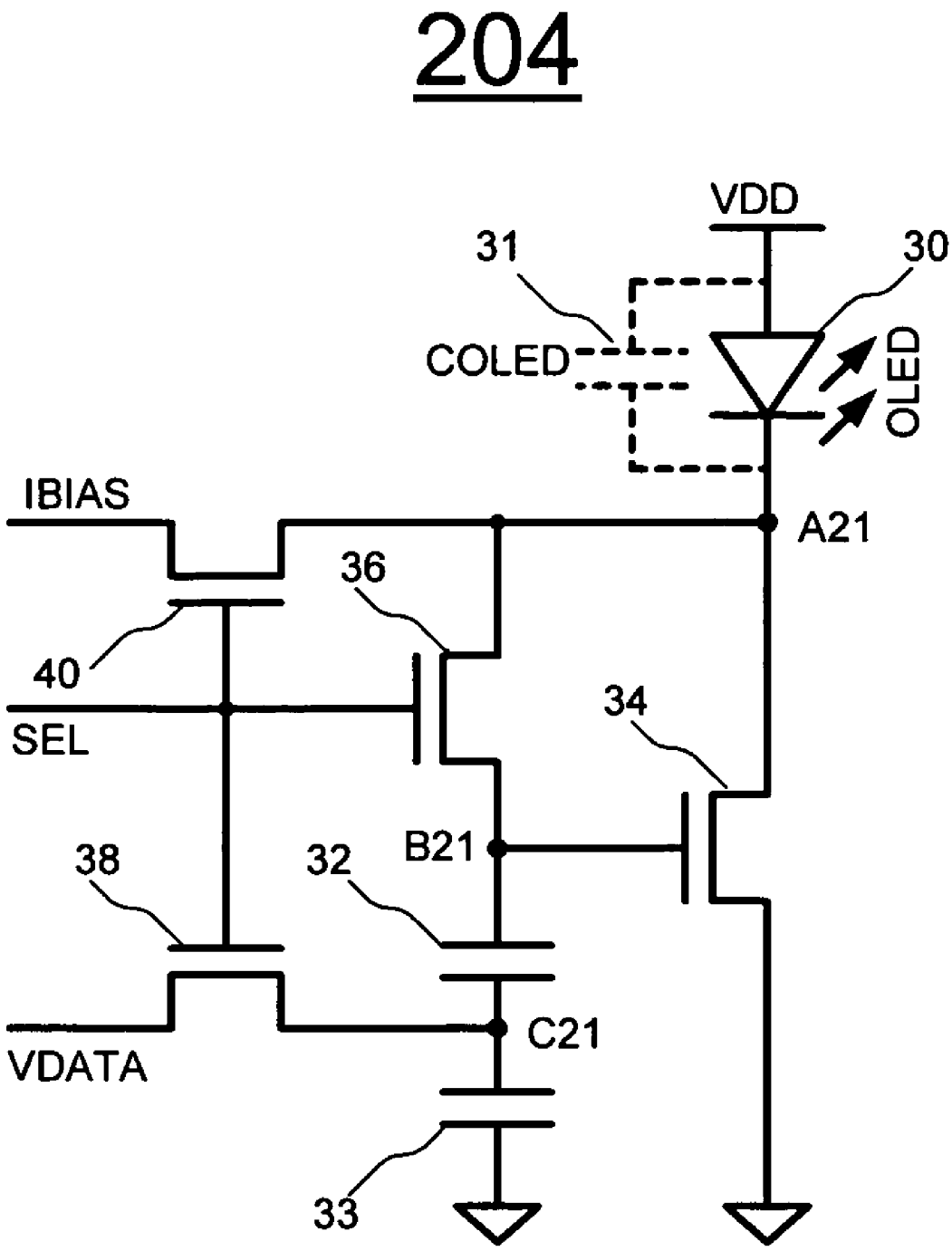
FIG. 8 is a diagram showing a pixel circuit in accordance with a further embodiment of the present invention.

FIG. 8 illustrates a pixel circuit 204 in accordance with an embodiment of the present invention. The pixel circuit 204 employs the CBVP driving scheme as described below. The pixel circuit 204 of FIG. 8 includes an OLED 30, storage capacitors 32 and 33, a driving transistor 34, and switch transistors 36, 38 and 40. Each of the transistors 34, 36, 38 and 40 includes a gate terminal, a first terminal and a second terminal. This pixel circuit 204 operates in the same way as that of the pixel circuit 200.

Figure 10:
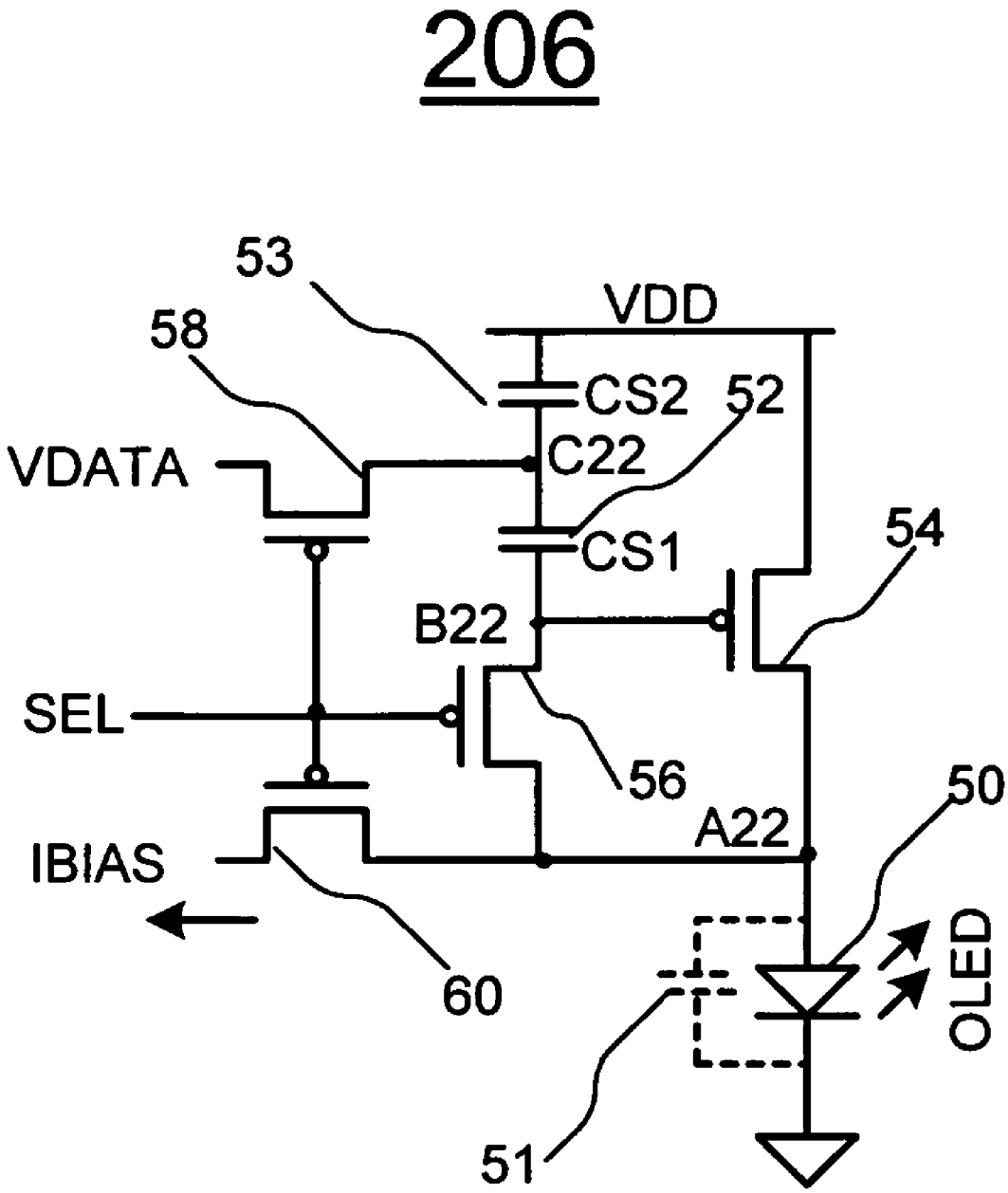
FIG. 10 is a diagram showing a pixel circuit which has p-type transistors and corresponds to the pixel circuit of FIG. 8.

The transistors 34, 36, 38 and 40 are n-type TFT transistors. The driving technique applied to the pixel circuit 204 is also applicable to a complementary pixel circuit having p-type transistors, as shown in FIG. 10.

The transistors 34, 36, 38 and 40 may be fabricated using amorphous silicon, nano/micro crystalline silicon, poly silicon, organic semiconductors technologies (e.g. organic TFTs), NMOS technology, or CMOS technology (e.g. MOSFET). A plurality of pixel circuits 204 may form an AMOLED display array.

A select line SEL, a signal line VDATA, a bias line IBIAS, a voltage line VDD, and a common ground are provided to the pixel circuit 204.

The first terminal of the driving transistor 34 is connected to the cathode electrode of the OLED 30. The second terminal of the driving transistor 34 is connected to the ground. The gate terminal of the driving transistor 34 is connected to its first terminal through the switch transistor 36. The storage capacitors 32 and 33 are in series and connected between the gate of the driving transistor 34 and the ground.

The gate terminal of the switch transistor 36 is connected to the select line SEL. The first terminal of the switch transistor 36 is connected to the first terminal of the driving transistor 34. The second terminal of the switch transistor 36 is connected to the gate terminal of the driving transistor 34.

The gate terminal of the switch transistor 38 is connected to the select line SEL. The first terminal of the switch transistor 38 is connected to the signal line VDATA. The second terminal of the switch transistor 38 is connected to the connected terminal of the storage capacitors 32 and 33 (i.e. node C21).

The gate terminal of the switch transistor 40 is connected to the select line SEL. The first terminal of the switch transistor 40 is connected to the bias line IBIAS. The second terminal of the switch transistor 40 is connected to the cathode terminal of the OLED 30. The anode electrode of the OLED 30 is connected to the VDD.

The OLED 30, the transistors 34, 36 and 40 are connected at node A21. The storage capacitor 32 and the transistors 34 and 36 are connected at node B21.

The operation of the pixel circuit 204 includes a programming phase having a plurality of programming cycles, and a driving phase having one driving cycle. During the programming phase, the first storage capacitor 32 is charged to a programming voltage VP plus the threshold voltage of the driving transistor 34, and the second storage capacitor 33 is charged to zero As a result, the gate-source voltage of the driving transistor 34 is:

$$VGS=VP+VT \tag{5}$$

where VGS represents the gate-source voltage of the driving transistor 34, and VT represents the threshold voltage of the driving transistor 34.

Figure 9:
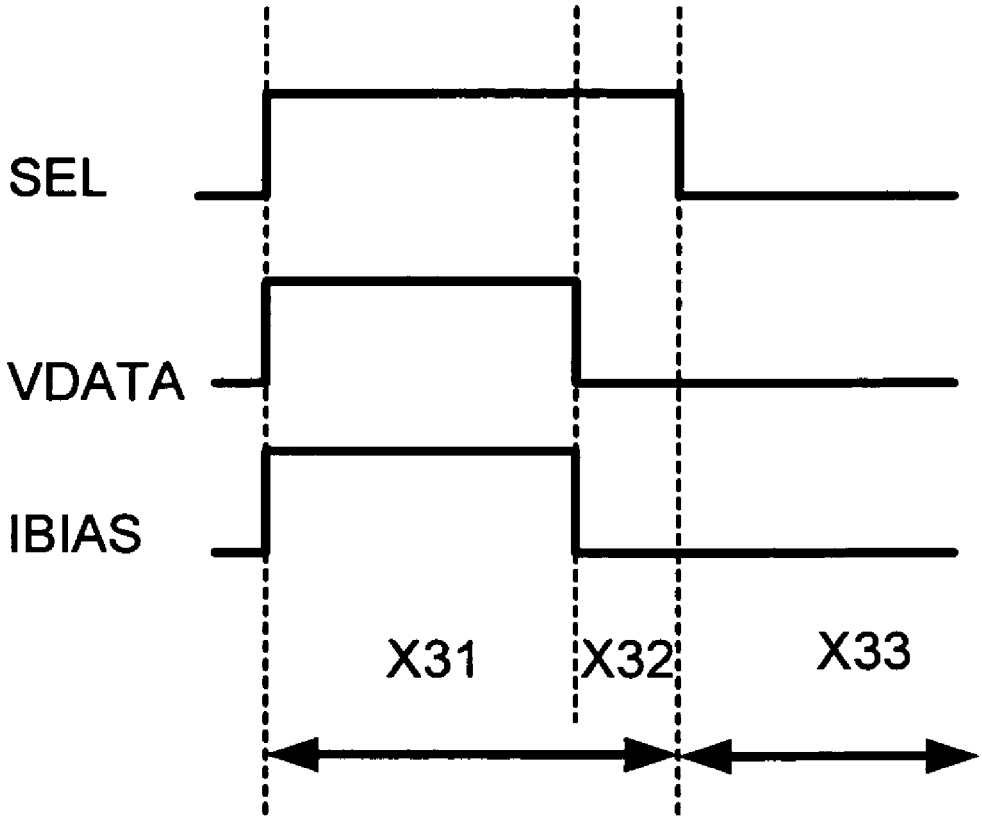
FIG. 9 is a timing diagram showing exemplary waveforms applied to the pixel circuit of FIG. 8.

The programming and driving phases of the pixel circuit 204 are described in detail. FIG. 9 illustrates one exemplary operation process applied to the pixel circuit 204 of FIG. 8. As shown in FIG. 9, the programming phase has two operation cycles X31, X32, and the driving phase has one operation cycle X33.

The first operation cycle X31: The select line SEL is high. A bias current IB flows through the bias line IBIAS, and VDATA goes to a VB−VP where VP is and programming voltage and VB is given by:

$$VB=\sqrt{\frac{I\beta}{\beta}} \tag{6}$$

As a result, the voltage stored in the first capacitor 32 is:

$$VC1=VP+VT \tag{7}$$

where VC1 represents the voltage stored in the first storage capacitor 32, VT represents the threshold voltage of the driving transistor 34, β represents the coefficient in current-voltage (I-V) characteristics of the TFT given by $IDS=\beta(VGS-VT)^2$. IDS represents the drain-source current of the driving transistor 34.

The second operation cycle: While SEL is high, VDATA is zero, and IBIAS goes to zero. Because the capacitance 31 of the OLED 30 and the parasitic capacitance of the bias line IBIAS are large, the voltage of node B21 and the voltage of node A21 generated in the previous cycle stay unchanged.

Therefore, the gate-source voltage of the driving transistor 34 can be found as:

$$VGS=VP+VT \tag{8}$$

where VGS represents the gate-source voltage of the driving transistor 34.

The gate-source voltage of the driving transistor 34 is stored in the storage capacitor 32.

The third operation cycle X33: IBIAS goes to zero. SEL goes to zero. The voltage of node C21 goes to zero. The voltage stored in the storage capacitor 32 is applied to the gate terminal of the driving transistor 34. The gate-source voltage of the driving transistor 34 develops over the voltage stored in the storage capacitor 32. Considering that the current of driving transistor 34 is mainly defined by its gate-source voltage, the current through the OLED 30 becomes independent of the shifts of the threshold voltage of the driving transistor 34 and OLED characteristics.

Figure 11:
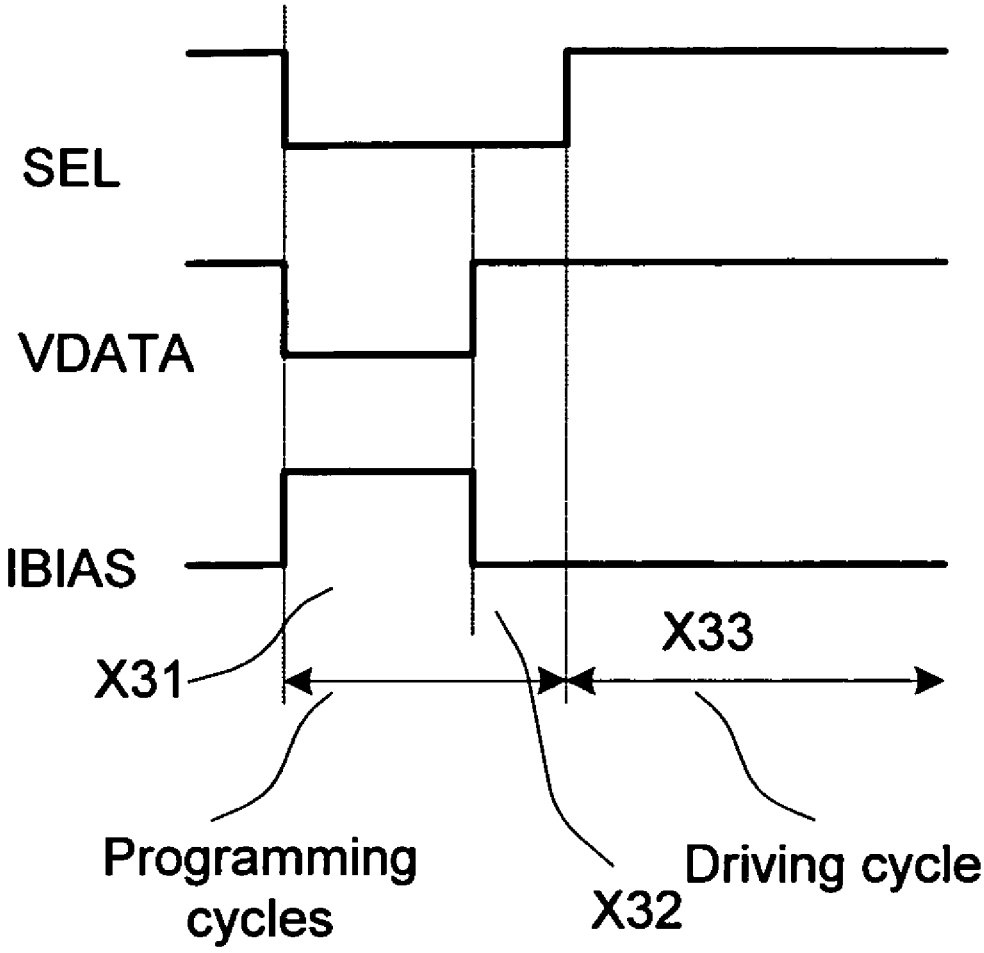
FIG. 11 is a timing diagram showing exemplary waveforms applied to the pixel circuit of FIG. 10.

FIG. 10 illustrates a pixel circuit 206 having p-type transistors. The pixel circuit 206 corresponds to the pixel circuit 204 of FIG. 8. The pixel circuit 206 employs the CBVP driving scheme as shown in FIG. 11. The pixel circuit 206 of FIG. 10 includes an OLED 50, a storage capacitors 52 and 53, a driving transistor 54, and switch transistors 56, 58 and 60. The transistors 54, 56, 58 and 60 are p-type transistors. Each transistor has a gate terminal, a first terminal and a second terminal.

The transistors 54, 56, 58 and 60 may be fabricated using amorphous silicon, nano/micro crystalline silicon, poly silicon, organic semiconductors technologies (e.g. organic TFTs), PMOS technology, or CMOS technology (e.g. MOSFET). A plurality of pixel circuits 206 may form an AMOLED display array.

Two select lines SEL1 and SEL2, a signal line VDATA, a bias line IBIAS, a voltage supply line VDD, and a common ground are provided to the pixel circuit 206. The common ground may be same as that of FIG. 1.

The anode electrode of the OLED 50, the transistors 54, 56 and 60 are connected at node A22. The storage capacitor 52 and the transistors 54 and 56 are connected at node B22. The switch transistor 58, and the storage capacitors 52 and 53 are connected at node C22.

FIG. 11 illustrates one exemplary operation process applied to the pixel circuit 206 of FIG. 10. FIG. 11 corresponds to FIG. 9. As shown in FIG. 11, the CBVP driving scheme of FIG. 11 uses IBIAS and VDATA similar to those of FIG. 9.

Figure 12:
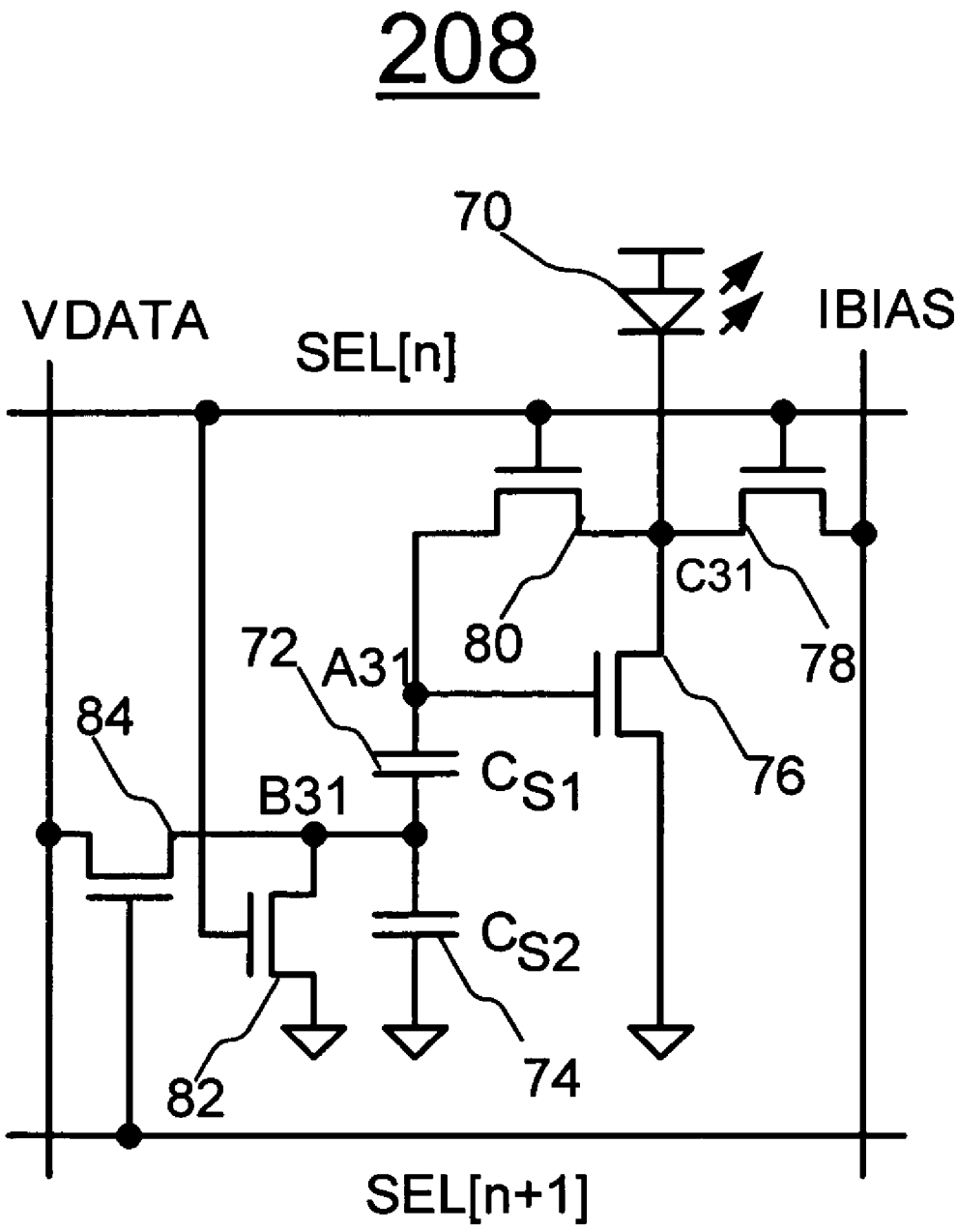
FIG. 12 is a diagram showing a pixel circuit in accordance with an embodiment of the present invention.

FIG. 12 illustrates a display 208 in accordance with an embodiment of the present invention. The display 208 employs the CBVP driving scheme as described below. In FIG. 12, elements associated with two rows and one column are shown as example. The display 208 may include more than two rows and more than one column.

The display 208 includes an OLED 70, storage capacitors 72 and 74, transistors 76, 78, 80, 82 and 84. The transistor 76 is a driving transistor. The transistors 78, 80 and 84 are switch transistors. Each of the transistors 76, 78, 80, 82 and 84 includes a gate terminal, a first terminal and a second terminal.

Figure 16:
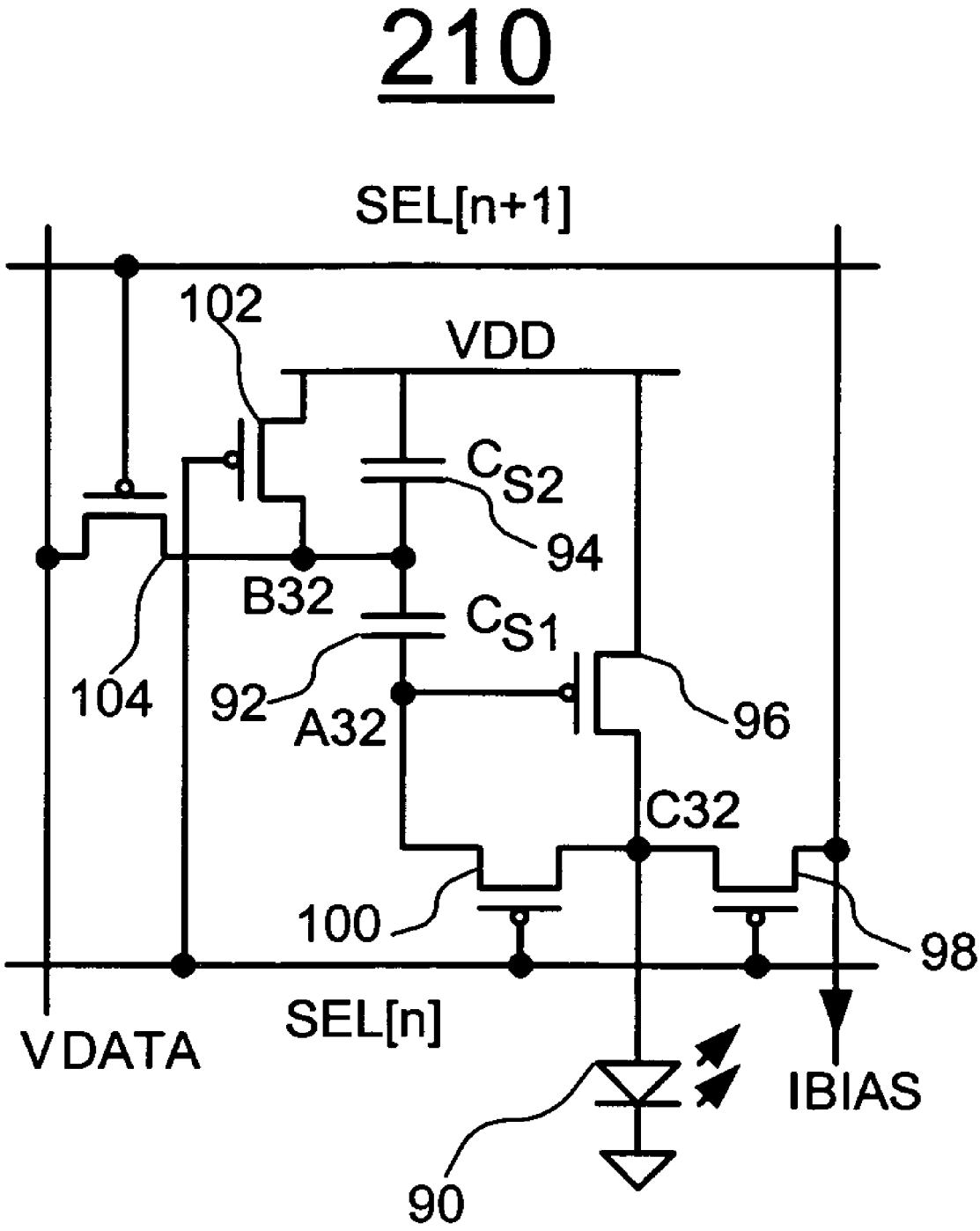
FIG. 16 is a diagram showing a pixel circuit which has p-type transistors and corresponds to the pixel circuit of FIG. 12.

The transistors 76, 78, 80, 82 and 84 are n-type TFT transistors. The driving technique applied to the pixel circuit 208 is also applicable to a complementary pixel circuit having p-type transistors, as shown in FIG. 16.

The transistors 76, 78, 80, 82 and 84 may be fabricated using amorphous silicon, nano/micro crystalline silicon, poly silicon, organic semiconductors technologies (e.g. organic TFTs), NMOS technology, or CMOS technology (e.g. MOSFET). The display 208 may form an AMOLED display array. The combination of the CBVP driving scheme and the display 208 provides a large-area, high-resolution AMOLED display.

The transistors 76 and 80 and the storage capacitor 72 are connected at node A31. The transistors 82 and 84 and the storage capacitors 72 and 74 are connected at B31.

Figure 13:
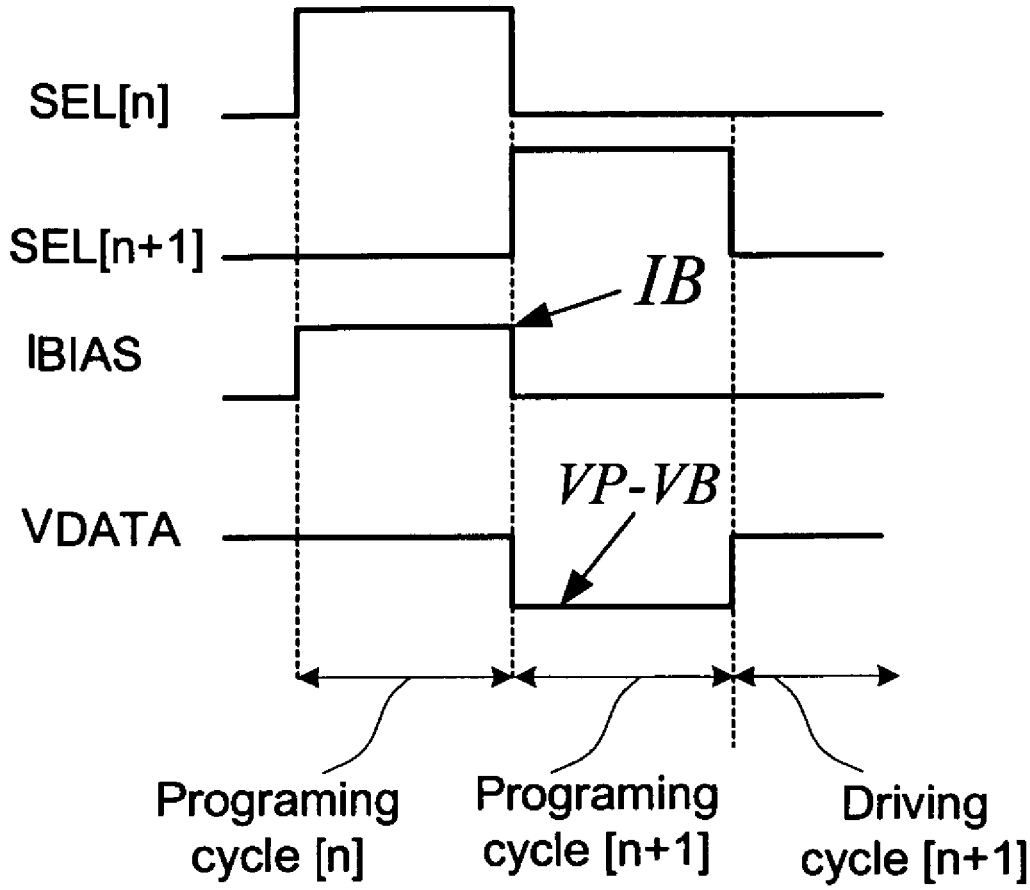
FIG. 13 is a timing diagram showing exemplary waveforms applied to the display of FIG. 12.

FIG. 13 illustrates one exemplary operation process applied to the display 208 of FIG. 12. In FIG. 13, "Programming cycle [n]" represents a programming cycle for the row [n] of the display 208.

The programming time is shared between two consecutive rows (n and n+1). During the programming cycle of the nth row, SEL[n] is high, and a bias current IB is flowing through the transistors 78 and 80. The voltage at node A31 is self-adjusted to $(IB/\beta)^{1/2}+VT$, while the voltage at node B31 is zero, where VT represents the threshold voltage of the driving transistor 76, and β represents the coefficient in current-voltage (I-V) characteristics of the TFT given by $IDS=\beta(VGS-VT)^2$, and IDS represents the drain-source current of the driving transistor 76.

During the programming cycle of the (n+1)th row, VDATA changes to VP−VB. As a result, the voltage at node A31 changes to VP+VT if $VB=(IB/\beta)^{1/2}$. Since a constant current is adopted for all the pixels, the IBIAS line consistently has the appropriate voltage so that there is no necessity to pre-charge the line, resulting in shorter programming time and lower power consumption. More importantly, the voltage of node B31 changes from VP−VB to zero at the beginning of the programming cycle of the nth row. Therefore, the voltage at node A31 changes to $(IB/\beta)^{1/2}+VT$, and it is already adjusted to its final value, leading to a fast settling time.

Figure 14:
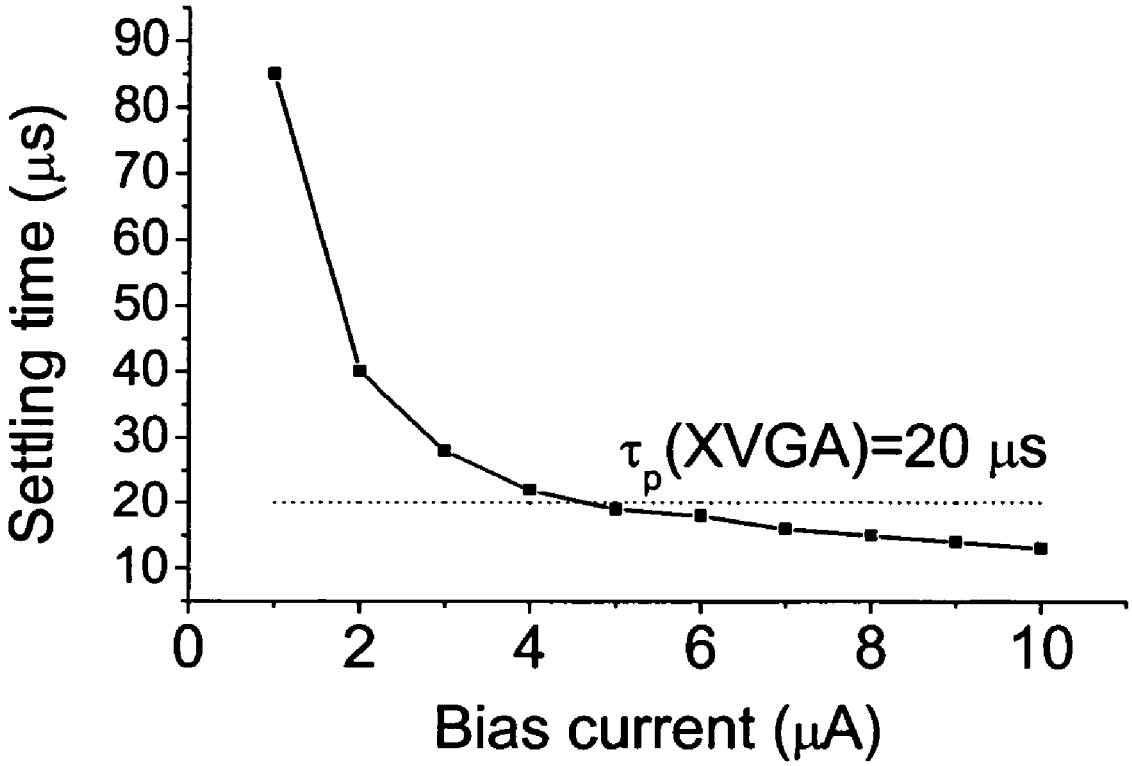
FIG. 14 is a graph showing the settling time of a CBVP pixel circuit for different bias currents.

The settling time of the CBVP pixel circuit is depicted in FIG. 14 for different bias currents. A small current can be used as IB here, resulting in lower power consumption.

Figure 15:
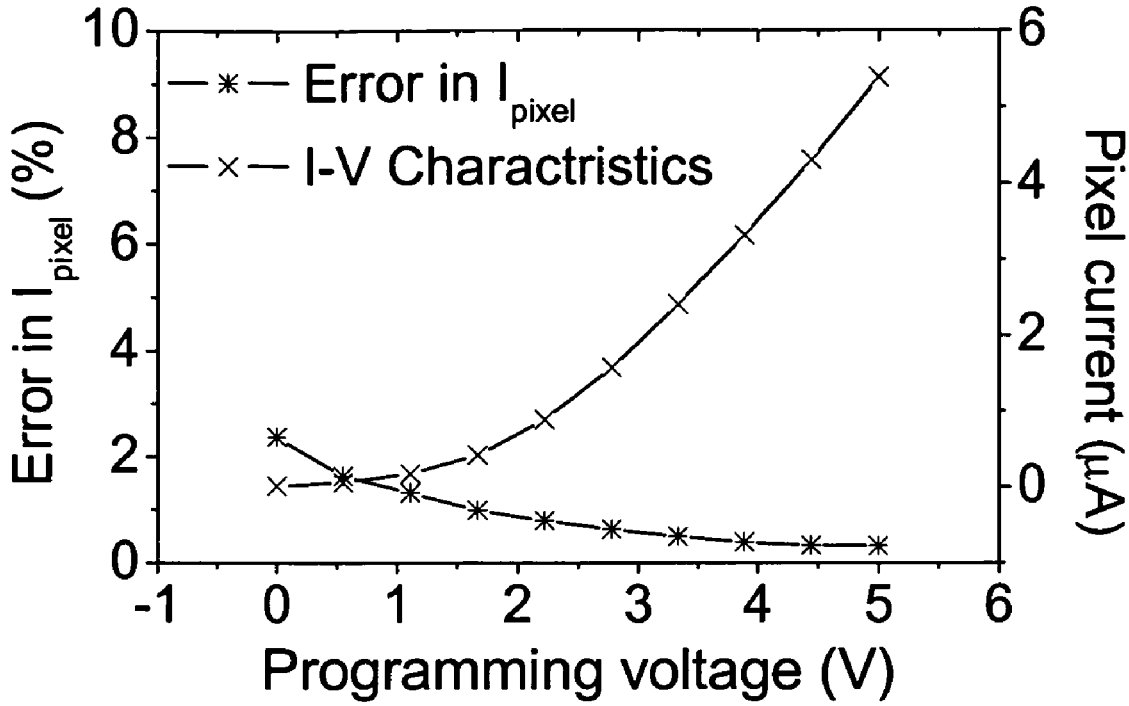
FIG. 15 is a graph showing I-V characteristic of the CBVP pixel circuit as well as the total error induced in the pixel current.

FIG. 15 illustrates I-V characteristic of the CBVP pixel circuit as well as the total error induced in the pixel current due to a 2-V shift in the threshold voltage of a driving transistor (e.g. 76 of FIG. 12). The result indicates the total error of less than 2% in the pixel current. It is noted that IB=4.5 μA.

Figure 17:
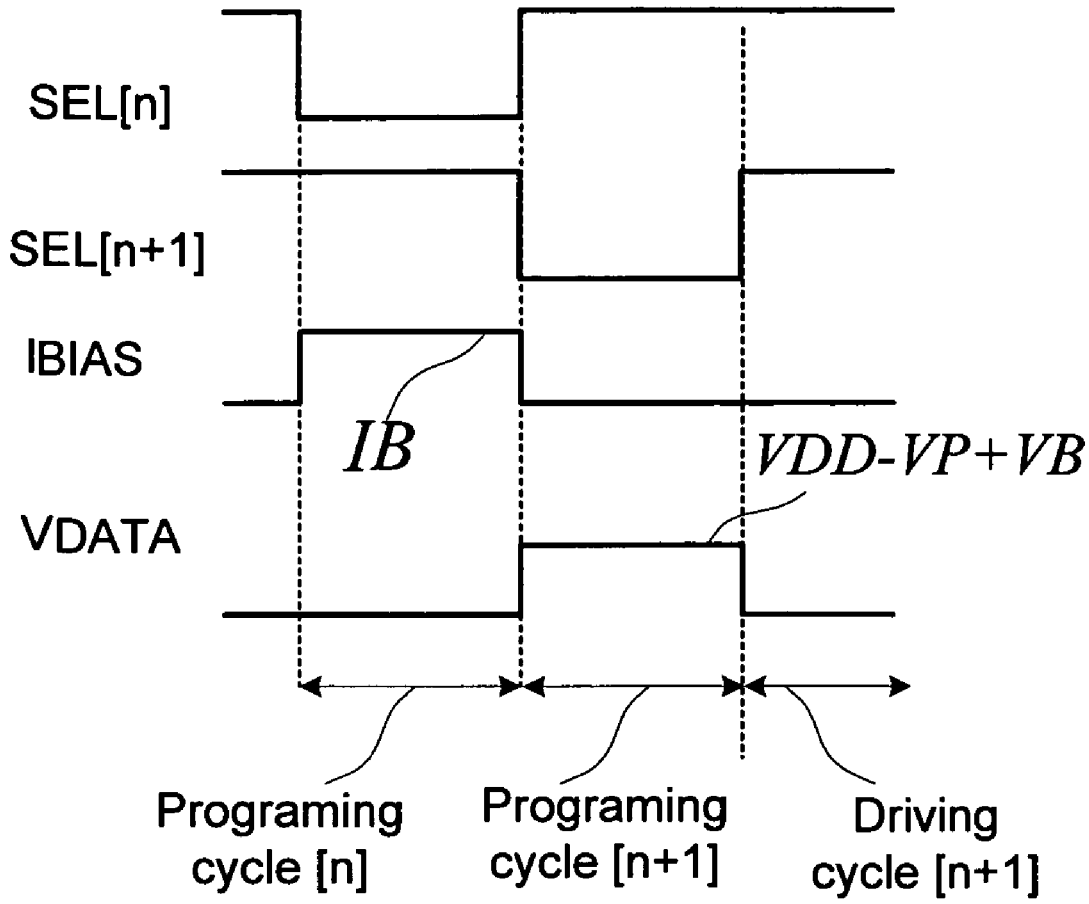
FIG. 17 is a timing diagram showing exemplary waveforms applied to the display of FIG. 16.

FIG. 16 illustrates a display 210 having p-type transistors. The display 210 corresponds to the display 208 of FIG. 12. The display 210 employs the CBVP driving scheme as shown in FIG. 17. In FIG. 12, elements associated with two rows and one column are shown as example. The display 210 may include more than two rows and more than one column.

The display 210 includes an OLED 90, a storage capacitors 92 and 94, and transistors 96, 98, 100, 102 and 104. The transistor 96 is a driving transistor. The transistors 100 and 104 are switch transistors. The transistors 24, 26 and 28 are p-type transistors. Each transistor has a gate terminal, a first terminal and a second terminal.

The transistors 96, 98, 100, 102 and 104 may be fabricated using amorphous silicon, nano/micro crystalline silicon, poly silicon, organic semiconductors technologies (e.g. organic TFTs), PMOS technology, or CMOS technology (e.g. MOSFET). The display 210 may form an AMOLED display array.

In FIG. 16, the driving transistor 96 is connected between the anode electrode of the OLED 90 and a voltage supply line VDD.

FIG. 17 illustrates one exemplary operation process applied to the display 210 of FIG. 16. FIG. 17 corresponds to FIG. 13. The CBVP driving scheme of FIG. 17 uses IBIAS and VDATA similar to those of FIG. 13.

According to the CBVP driving scheme, the overdrive voltage provided to the driving transistor is generated so as to be independent from its threshold voltage and the OLED voltage.

The shift(s) of the characteristic(s) of a pixel element(s) (e.g. the threshold voltage shift of a driving transistor and the degradation of a light emitting device under prolonged display operation) is compensated for by voltage stored in a storage capacitor and applying it to the gate of the driving transistor. Thus, the pixel circuit can provide a stable current though the light emitting device without any effect of the shifts, which improves the display operating lifetime. Moreover, because of the circuit simplicity, it ensures higher product yield, lower fabrication cost and higher resolution than conventional pixel circuits.

Since the settling time of the pixel circuits described above is much smaller than conventional pixel circuits, it is suitable for large-area display such as high definition TV, but it also does not preclude smaller display areas either.

It is noted that a driver for driving a display array having a CBVP pixel circuit (e.g. 200, 202 or 204) converts the pixel luminance data into voltage.

A driving technique for pixels, including voltage-biased current-programmed (VBCP) driving scheme is now described in detail. In the VBCP driving scheme, a pixel current is scaled down without resizing mirror transistors. The VBCP driving scheme uses current to provide for different gray scales (current programming), and uses a bias to accelerate the programming and compensate for a time dependent parameter of a pixel, such as a threshold voltage shift. One of the terminals of a driving transistor is connected to a virtual ground VGND. By changing the voltage of the virtual ground, the pixel current is changed. A bias current IB is added to a programming current IP at a driver side, and then the bias current is removed from the programming current inside the pixel circuit by changing the voltage of the virtual ground.

Figure 18:
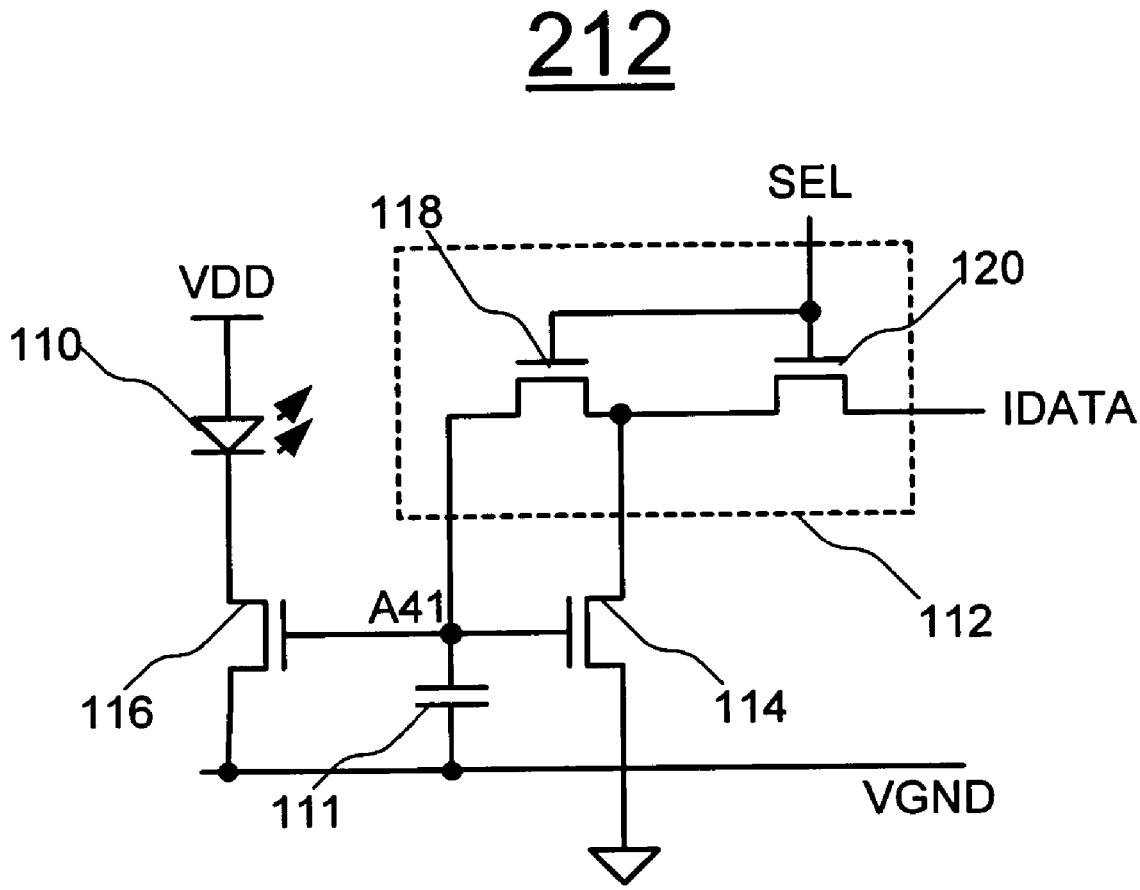
FIG. 18 is a diagram showing a VBCP pixel circuit in accordance with a further embodiment of the present invention.

FIG. 18 illustrates a pixel circuit 212 in accordance with a further embodiment of the present invention. The pixel circuit 212 employs the VBCP driving scheme as described below. The pixel circuit 212 of FIG. 18 includes an OLED 110, a storage capacitor 111, a switch network 112, and mirror transistors 114 and 116. The mirror transistors 114 and 116 form a current mirror. The transistor 114 is a programming transistor. The transistor 116 is a driving transistor. The switch network 112 includes switch transistors 118 and 120. Each of the transistors 114, 116, 118 and 120 has a gate terminal, a first terminal and a second terminal.

Figure 20:
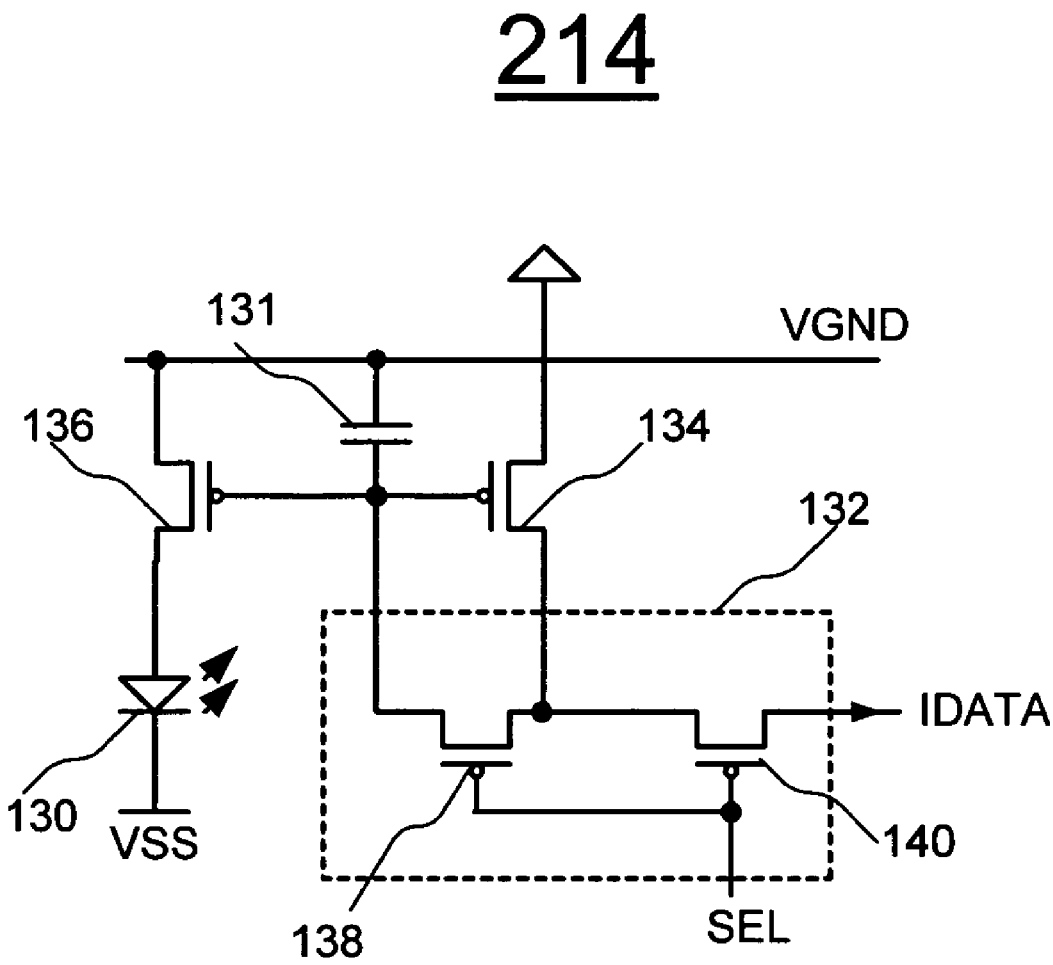
FIG. 20 is a diagram showing a VBCP pixel circuit which has p-type transistors and corresponds to the pixel circuit of FIG. 18.

The transistors 114, 116, 118 and 120 are n-type TFT transistors. The driving technique applied to the pixel circuit 212 is also applicable to a complementary pixel circuit having p-type transistors as shown in FIG. 20.

The transistors 114, 116, 118 and 120 may be fabricated using amorphous silicon, nano/micro crystalline silicon, poly silicon, organic semiconductors technologies (e.g. organic TFTs), NMOS technology, or CMOS technology (e.g. MOSFET). A plurality of pixel circuits 212 may form an AMOLED display array.

A select line SEL, a signal line IDATA, a virtual grand line VGND, a voltage supply line VDD, and a common ground are provided to the pixel circuit 150.

The first terminal of the transistor 116 is connected to the cathode electrode of the OLED 110. The second terminal of the transistor 116 is connected to the VGND. The gate terminal of the transistor 114, the gate terminal of the transistor 116, and the storage capacitor 111 are connected to a connection node A41.

The gate terminals of the switch transistors 118 and 120 are connected to the SEL. The first terminal of the switch transistor 120 is connected to the IDATA. The switch transistors 118 and 120 are connected to the first terminal of the transistor 114. The switch transistor 118 is connected to node A41.

Figure 19:
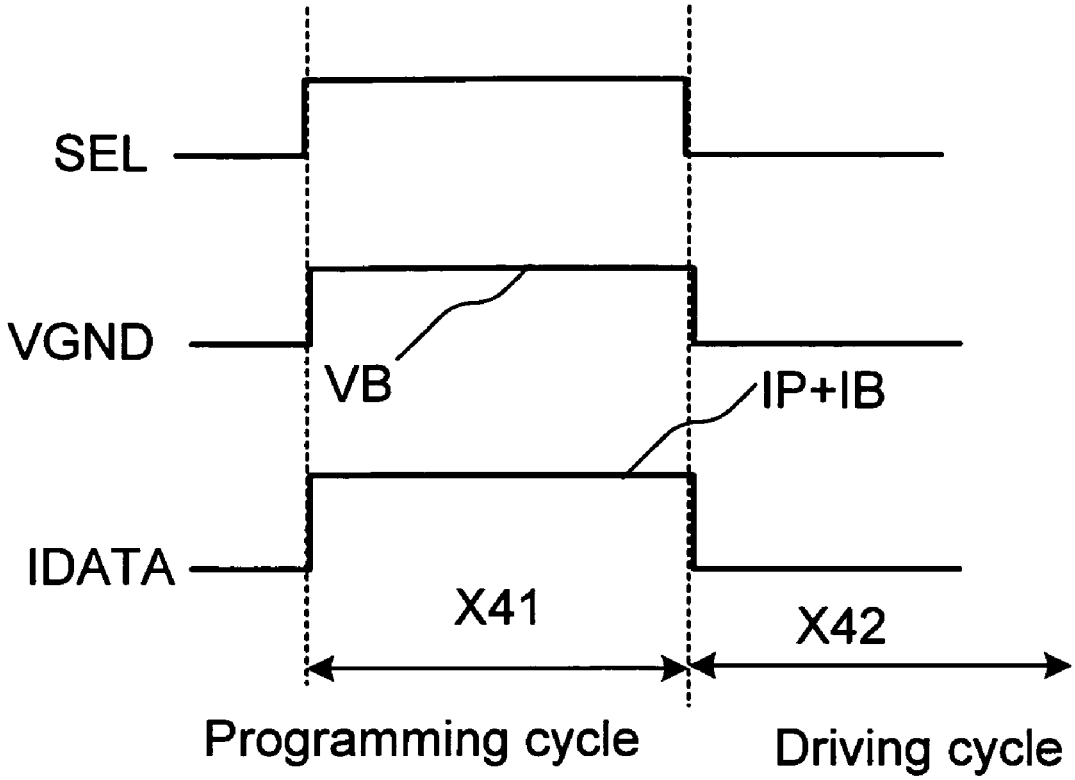
FIG. 19 is a timing diagram showing exemplary waveforms applied to the pixel circuit of FIG. 18.

FIG. 19 illustrates an exemplary operation for the pixel circuit 212 of FIG. 18. Referring to FIGS. 18 and 19, current scaling technique applied to the pixel circuit 212 is described in detail. The operation of the pixel circuit 212 has a programming cycle X41, and a driving cycle X42.

The programming cycle X41: SEL is high. Thus, the switch transistors 118 and 120 are on. The VGND goes to a bias voltage VB. A current (IB+IP) is provided through the IDATA, where IP represents a programming current, and IB represents a bias current. A current equal to (IB+IP) passes through the switch transistors 118 and 120.

The gate-source voltage of the driving transistor 116 is self-adjusted to:

$$VGS = \sqrt{\frac{IP + IB}{\beta}} + VT \tag{9}$$

where VT represents the threshold voltage of the driving transistor 116, and β represents the coefficient in current-voltage (I-V) characteristics of the TFT given by IDS=β(VGS−VT)$^2$. IDS represents the drain-source current of the driving transistor 116.

The voltage stored in the storage capacitor 111 is:

$$VCS = \sqrt{\frac{IP + IB}{\beta}} - VB + VT \tag{10}$$

where VCS represents the voltage stored in the storage capacitor 111.

Since one terminal of the driving transistor 116 is connected to the VGND, the current flowing through the OLED 110 during the programming time is:

$$Ipixel = IP + IB + \beta\cdot(VB)^2 - 2\sqrt{\beta}\cdot VB\cdot\sqrt{(IP+IB)} \tag{11}$$

where Ipixel represents the pixel current flowing through the OLED 110.

If IB>>IP, the pixel current Ipixel can be written as:

$$Ipixel = IP + (IB + \beta\cdot(VB)^2 - 2\sqrt{\beta}\cdot VB\cdot\sqrt{IB}) \tag{12}$$

VB is chosen properly as follows:

$$VB = \sqrt{\frac{IB}{\beta}} \tag{13}$$

The pixel current Ipixel becomes equal to the programming current IP. Therefore, it avoids unwanted emission during the programming cycle.

Since resizing is not required, a better matching between two mirror transistors in the current-mirror pixel circuit can be achieved.

FIG. 20 illustrates a pixel circuit 214 having p-type transistors. The pixel circuit 214 corresponds to the pixel circuit 212 of FIG. 18. The pixel circuit 214 employs the VBCP driving scheme as shown FIG. 21. The pixel circuit 214 includes an OLED 130, a storage capacitor 131, a switch network 132, and mirror transistors 134 and 136. The mirror transistors 134 and 136 form a current mirror. The transistor 134 is a programming transistor. The transistor 136 is a driving transistor. The switch network 132 includes switch transistors 138 and 140. The transistors 134, 136, 138 and 140 are p-type TFT transistors. Each of the transistors 134, 136, 138 and 140 has a gate terminal, a first terminal and a second terminal.

The transistors 134, 136, 138 and 140 may be fabricated using amorphous silicon, nano/micro crystalline silicon, poly silicon, organic semiconductors technologies (e.g. organic TFTs), PMOS technology, or CMOS technology (e.g. MOSFET). A plurality of pixel circuits 214 may form an AMOLED display array.

A select line SEL, a signal line IDATA, a virtual grand line VGND, and a voltage supply line VSS are provided to the pixel circuit 214.

The transistor 136 is connected between the VGND and the cathode electrode of the OLED 130. The gate terminal of the transistor 134, the gate terminal of the transistor 136, the storage capacitor 131 and the switch network 132 are connected at node A42.

Figure 21:
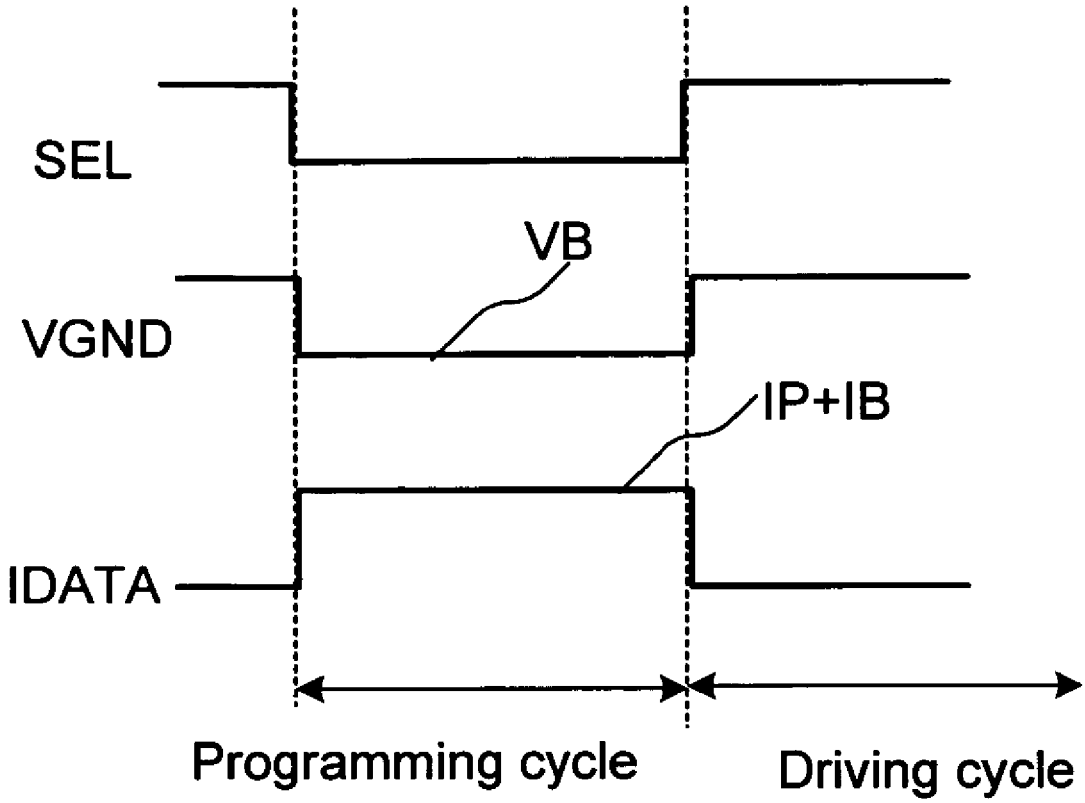
FIG. 21 is a timing diagram showing exemplary waveforms applied to the pixel circuit of FIG. 20.

FIG. 21 illustrates an exemplary operation for the pixel circuit 214 of FIG. 20. FIG. 21 corresponds to FIG. 19. The VBCP driving scheme of FIG. 21 uses IDATA and VGND similar to those of FIG. 19.

The VBCP technique applied to the pixel circuit 212 and 214 is applicable to current programmed pixel circuits other than current mirror type pixel circuit.

For example, the VBCP technique is suitable for the use in AMOLED displays. The VBCP technique enhances the settling time of the current-programmed pixel circuits display, e.g. AMOLED displays.

It is noted that a driver for driving a display array having a VBCP pixel circuit (e.g. 212, 214) converts the pixel luminance data into current.

Figure 22:
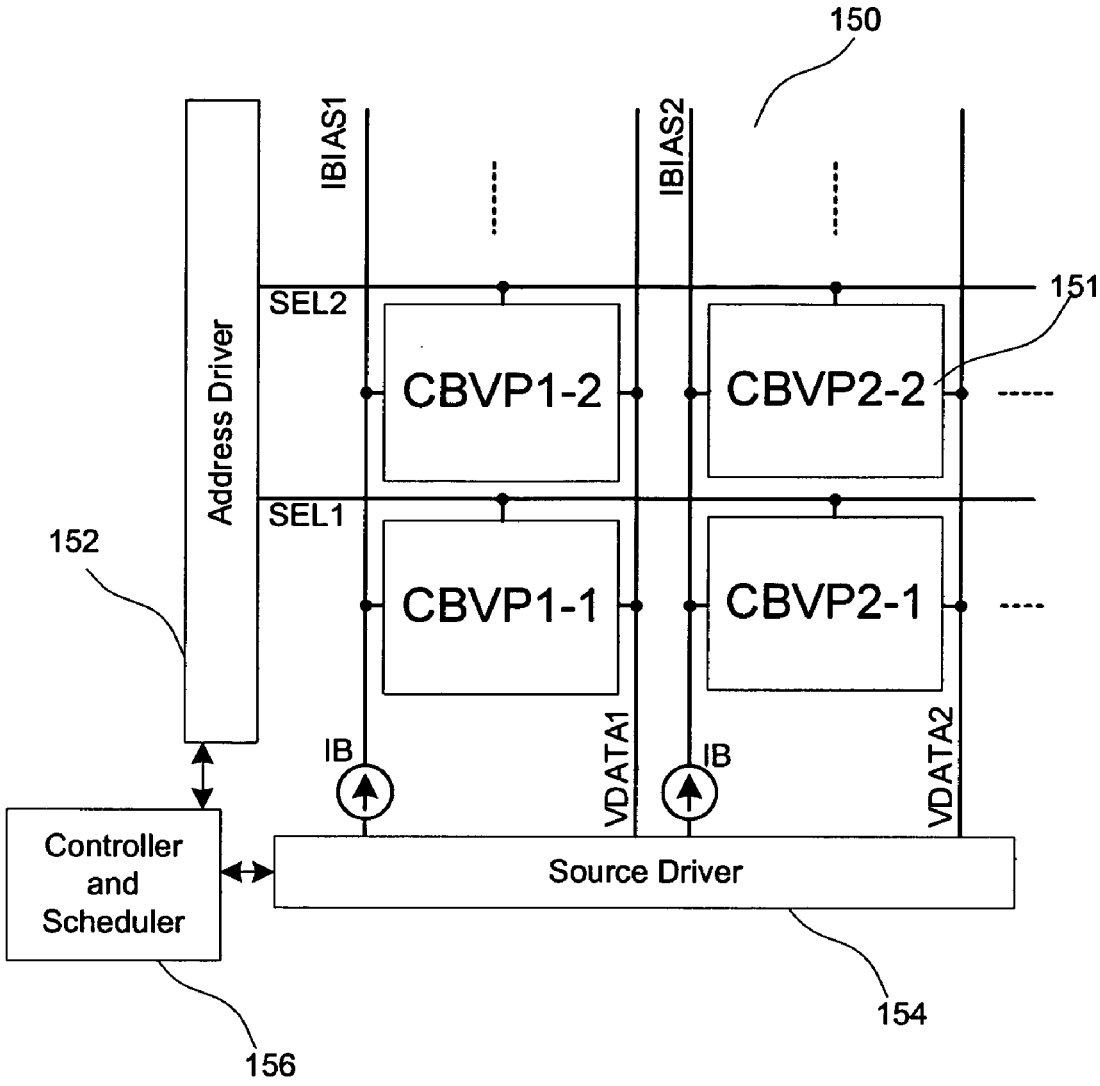
FIG. 22 is a diagram showing a driving mechanism for a display array having CBVP pixel circuits.

FIG. 22 illustrates a driving mechanism for a display array 150 having a plurality of CBVP pixel circuits 151 (CBVP1-1, CBVP1-2, CBVP2-1, CBVP2-2). The CBVP pixel circuit 151 is a pixel circuit to which the CBVP driving scheme is applicable. For example, the CBVP pixel circuit 151 may be the pixel circuit shown in FIG. 1, 5, 8, 10, 12 or 16. In FIG. 22, four CBVP pixel circuits 151 are shown as example. The display array 150 may have more than four or less than four CBVP pixel circuits 151.

The display array 150 is an AMOLED display where a plurality of the CBVP pixel circuits 151 are arranged in rows and columns. VDATA1 (or VDATA2) and IBIAS1 (or IBIAS2) are shared between the common column pixels while SEL1 (or SEL2) is shared between common row pixels in the array structure.

The SEL1 and SEL2 are driven through an address driver 152. The VDATA1 and VDATA2 are driven through a source driver 154. The IBIAS1 and IBIAS2 are also driven through the source driver 154. A controller and scheduler 156 is provided for controlling and scheduling programming, calibration and other operations for operating the display array, which includes the control and schedule for the CBVP driving scheme as described above.

Figure 23:
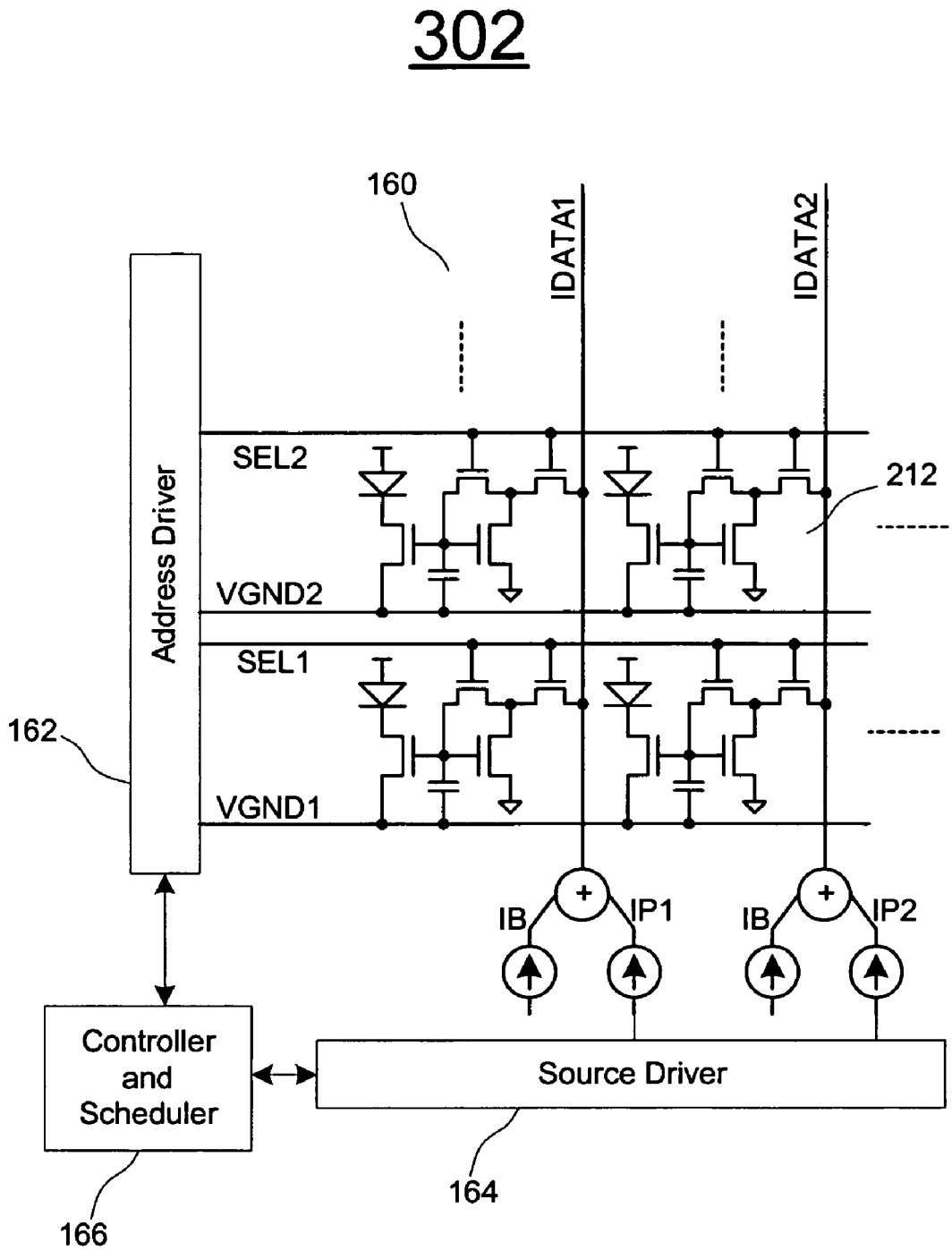
FIG. 23 is a diagram showing a driving mechanism for a display array having VBCP pixel circuits.

FIG. 23 illustrates a driving mechanism for a display array 160 having a plurality of VBCP pixel circuits. In FIG. 23, the pixel circuit 212 of FIG. 18 is shown as an example of the VBCP pixel circuit. However, the display array 160 may include any other pixel circuits to which the VBCP driving scheme described is applicable.

SEL1 and SEL2 of FIG. 23 correspond to SEL of FIG. 18. VGND1 and VGAND2 of FIG. 23 correspond to VDATA of FIG. 18. IDATA1 and IDATA 2 of FIG. 23 correspond to IDATA of FIG. 18. In FIG. 23, four VBCP pixel circuits are shown as example. The display array 160 may have more than four or less than four VBCP pixel circuits.

The display array 160 is an AMOLED display where a plurality of the VBCP pixel circuits are arranged in rows and columns. IDATA1 (or IDATA2) is shared between the common column pixels while SEL1 (or SEL2) and VGND1 (or VGND2) are shared between common row pixels in the array structure.

The SEL1, SEL2, VGND1 and VGND2 are driven through an address driver 162. The IDATA1 and IDATA are driven through a source driver 164. A controller and scheduler 166 is provided for controlling and scheduling programming, calibration and other operations for operating the display array, which includes the control and schedule for the VBCP driving scheme as described above.

All citations are hereby incorporated by reference.

The present invention has been described with regard to one or more embodiments. However, it will be apparent to persons skilled in the art that a number of variations and modifications can be made without departing from the scope of the invention as defined in the claims.

What is claimed is:

1. A display system comprising:

a pixel circuit having:

a light emitting device;

a capacitor;

a first switch transistor having a gate terminal, a first terminal and a second terminal, the gate terminal of the first switch transistor being connected to a first select line, one of the first and second terminals of the first switch transistor being connected to a signal line, the other terminal being connected to a first terminal of the capacitor;

a second switch transistor having a gate terminal, a first terminal and a second terminal, the gate terminal of the second switch transistor being connected to a second select line, one of the first and second terminals of the second switch transistor being connected to a second terminal of the capacitor and the light emitting device, the other terminal being connected to a bias line;

a driving transistor for driving the light emitting device, the driving transistor having a gate connected to the first terminal of the capacitor; and driver circuitry for programming the pixel circuit during a programming cycle and driving the pixel circuit during a driving cycle, the driver circuitry providing on the signal line a voltage or voltages as a function of a bias voltage and a programming voltage dependent on a programming data for said pixel circuit, and a controllable bias current, independent of said programming data for said pixel circuit, on the bias line to accelerate said programming and compensate for a time-dependent parameter of the pixel circuit.

2. A display system according to claim 1, wherein the light emitting device includes an organic light emitting diode.

3. A display system according to claim 1, wherein at least one of the transistors is a thin film transistor.

4. A display system according to claim 1, wherein at least one of the transistors is a n-type transistor.

5. A display system according to claim 1, wherein at least one of the transistors is a p-type transistor.

6. A display system according to claim 1, wherein a plurality of the pixel circuits are arranged in one or more row and one or more column to form an AMOLED display array.

7. The display system according to claim 1, wherein the light emitting device has a first terminal and a second terminal, the first terminal of the lighting device being connected to a first voltage supply, and the pixel circuit further includes a first capacitor and a second capacitor, each having a first terminal and a second terminal, and the transistors include:

a first switch transistor having a gate terminal, a first terminal and a second terminal, the gate terminal of the first switch transistor being connected to a select line, the first terminal of the first switch transistor being connected to a controllable bias line, the second terminal of the first switch transistor being connected to the second terminal of the light emitting device;

a second switch transistor having a gate terminal, a first terminal and a second terminal, the gate terminal of the second switch transistor being connected to the select line, the first terminal of the second switch transistor being connected to the second terminal of the first switch and the second terminal of the light emitting device, the second terminal of the second switch transistor being connected to the first terminal of the first capacitor;

a third switch transistor having a gate terminal, a first terminal and a second terminal, the gate terminal of the third switch transistor being connected to the select line, the first terminal of the third switch transistor being connected to a signal line, the second terminal of the third switch transistor being connected to the second terminal of the first capacitor and the first terminal of the second capacitor;

the driving transistor having a gate terminal, a first terminal and a second terminal, the gate terminal of the driving transistor being connected to the second terminal of the second switch transistor and the first terminal of the first capacitor, the first terminal of the driving transistor being connected to the second terminal of the light emitting device, the second terminal of the driving transistor being connected to a second voltage supply line.

8. The display system according to claim 1, wherein the light emitting device has a first terminal and a second terminal, the first terminal of the lighting device being connected to a first voltage supply, the pixel circuit includes a capacitor having a first terminal and a second terminal, the first terminal of the capacitor being connected to a virtual ground line, and the transistors include:

a switch network having a first switch transistor and a second switch transistor, each having a gate terminal, a first terminal and a second terminal;

first and second driving transistors forming a current mirror, each having a gate terminal, a first terminal and a second terminal, one of which is the driving transistor;

the gate terminal of the first switch transistor being connected to a select line, the first terminal of the first switch transistor being connected to a signal line, the second terminal of the first switch transistor being connected to the first terminal of the second switch transistor and the first terminal of the first driving transistor;

the gate terminal of the second switch transistor being connected to the select line, the second terminal of the second switch transistor being connected to the second terminal of the capacitor, the gate terminal of the first driving transistor and the gate terminal of the second driving transistor;

the second terminal of the first driving transistor being connected to a second voltage supply line:

the first terminal of the second driving transistor being connected to the second terminal of the light emitting device, the second terminal of the second driving transistor being connected to the virtual grand line.

9. The display system according to claim 6, wherein the pixel circuits are arranged so that the programming cycle of the nth row is overlapped with the programming cycle of the (n+1)th row.

10. A method of driving the pixel circuit of claim 1, comprising the steps of:

at a first programming cycle, providing a bias current to the pixel circuit, and a voltage defined by a programming voltage and a bias voltage;

at a second programming cycle, deactivating the bias signal.

11. A method of driving the pixel circuit of claim 1, comprising the steps of:

at a first programming cycle, providing the bias signal to the pixel circuit;

at a second programming cycle, deactivating the bias signal and providing a voltage defined by a bias voltage and a programming voltage.

12. A method of driving the pixel circuit of claim 1, comprising the steps of:

at a first programming cycle, providing a virtual voltage and a current defined by a programming current and a bias current;

at a second programming cycle, deactivating the virtual voltage and the current.

13. A method of driving pixel circuit of claim 1, comprising the step of:

providing a programming voltage, bias voltage or a combination thereof on a virtual ground connected to the pixel circuit.

14. A display system according to claim 1, wherein the pixel circuit is a current minor based pixel circuit.

15. A display system according to claim 1, comprising:

a controller for controlling the driver to generate a stable pixel current.

16. A display system according to claim 1, wherein the light emitting device includes a first terminal and a second terminal, and wherein the first or second terminal of the light emitting device is connected to the first or second terminal of the driving transistor.

17. A display system according to claim 1, wherein the driver, at the second operation of the programming cycle, deactivates the bias current on the bias line.

18. A pixel circuit comprising:

a light emitting device;

a capacitor having a first terminal and a second terminal;

a first switch transistor having a gate terminal, a first terminal and a second terminal, the gate terminal of the first switch transistor being connected to a first select line, one of the first and second terminals of the first switch transistor being connected to a signal line, the other terminal being connected to the first terminal of the capacitor, the signal line providing a bias voltage and a programming voltage dependent on a programming data for said pixel circuit during a programming cycle when the first switch transistor is enabled;

a second switch transistor having a gate terminal, a first terminal and a second terminal, the gate terminal of the second switch transistor being connected to a second select line, one of the first and second terminals of the second switch transistor being connected to the second terminal of the capacitor and the light emitting device, the other terminal being connected to a bias line that provides a controllable bias current, independent of said programming data for said pixel circuit, when the second switch transistor is enabled;

a driving transistor for driving the light emitting device, the driving terminal having a gate terminal connected to the first terminal of the capacitor;

wherein the bias voltage and the programming voltage provided by the first switch transistor and the bias current provided by the second switch transistor accelerate the programming of the pixel circuit and compensate for a time dependent parameter of the pixel circuit.

19. The display system according to claim 18 wherein the first select line and the second select line are a common select line.

20. A pixel circuit according to claim 18, wherein the light emitting device includes an organic light emitting diode.

21. A pixel circuit according to claim 18, wherein at least one of the transistors is a thin film transistor.

22. A pixel circuit according to claim 18, wherein at least one of the transistors is a n-type transistor.

23. A pixel circuit according to claim 18, wherein at least one of the transistors is a p-type transistor.

24. A pixel circuit according to claim 18, wherein the pixel circuit forms an AMOLED display array.

25. A pixel circuit according to claim 18, wherein the light emitting device includes a first terminal and a second terminal, and wherein the first or second terminal of the light emitting device is connected to the first or second terminal of the driving transistor.

26. A method of driving a pixel circuit, the pixel circuit comprising a light emitting device, a capacitor, a first switch transistor, a second switch transistor, and a driving transistor for driving the light emitting device, each transistor having a gate terminal, a first terminal and a second terminal, the capacitor having a first terminal and a second terminal, the gate terminal of the first switch transistor being connected to a first select line, one of the first and second terminals of the first switch transistor being connected to a signal line, the other terminal of the first switch transistor being connected to the first terminal of the capacitor, the gate terminal of the second switch transistor being connected to a second select line, one of the first and second terminals of the second switch transistor being connected to the second terminal of the capacitor and the light emitting device, the other terminal of the second switch transistor being connected to a bias line, the gate terminal of the driving transistor being connected to the first terminal of the capacitor, the method comprising the steps of:

at a first operation of a programming cycle, providing a bias voltage on the signal line and providing a controllable bias current, independent of said programming data for said pixel circuit, on the bias line; and at a second operation of the programming cycle, providing a programming voltage dependent on a programming data for said pixel circuit on the signal line, wherein said bias voltage and said programming voltage and said bias current accelerate the programming of the pixel circuit and compensate for a time dependent parameter of the pixel circuit.

27. A method according to claim 26, wherein the step of providing at the second operation of the programming cycle further comprises:

deactivating the bias on the bias line.

28. A method according to claim 26, wherein the step of providing at the second operation of the programming cycle further comprises:

deactivating the second select line.

29. A method of driving a display, the display comprising pixel circuits and driver circuitry for programming and driving the pixel circuit, each pixel circuit having a light emitting device, a capacitor, a first switch transistor, a second switch transistor and a driving transistor for driving the light emitting device, each transistor having a gate terminal, a first terminal and a second terminal, the capacitor having a first terminal and a second terminal, the gate terminal of the first switch transistor being connected to a first select line, one of the first and second terminals of the first switch transistor being connected to a signal line, the other terminal of the first switch transistor being connected to the first terminal of the capacitor, the gate terminal of the second switch transistor being connected to a second select line, one of the first and second terminals of the second switch transistor being connected to the second terminal of the capacitor and the light emitting device, the other terminal of the second switch transistor being connected to a bias line, the gate terminal of the driving transistor being connected to the first terminal of the capacitor; the method comprising:

at a first operation of a programming cycle, the driver circuitry providing a bias voltage on the signal line and providing a controllable bias current, independent of said programming data for said pixel circuit, on the bias line;

at a second operation of the programming cycle, the driver circuitry providing a programming voltage dependent on a programming data for said pixel circuit on the signal line, wherein said bias voltage and said programming voltage and said bias current accelerate the programming of the pixel circuit and compensate for a time dependent parameter of the pixel circuit.

30. A method according to claim 29, wherein the step of providing at the second operation of the programming cycle further comprises:

deactivating the bias current on the bias line.

31. A method according to claim 29, wherein the step of providing at the second operation of the programming cycle further comprises:

deactivating the second select line.

32. A method according to claim 29, wherein the driver, at the second operation of the programming cycle, deactivates the second select line.

* * * * *

UNITED STATES PATENT AND TRADEMARK OFFICE

CERTIFICATE OF CORRECTION

PATENT NO. : 7,889,159 B2
APPLICATION NO. : 11/274957
DATED : February 15, 2011
INVENTOR(S) : Arokia Nathan et al.

It is certified that error appears in the above-identified patent and that said Letters Patent is hereby corrected as shown below:

Correct Claim 14:

- In Claim 14, Column 14, Line 44:
Cancel the word "minor" and insert --mirror,--

Signed and Sealed this
Twenty-sixth Day of April, 2011

David J. Kappos

David J. Kappos
*Director of the United States Patent and Trademark Office*